US012448755B2

(12) United States Patent
Hayakawa et al.

(10) Patent No.: US 12,448,755 B2
(45) Date of Patent: Oct. 21, 2025

(54) WORK MACHINE MANAGEMENT SYSTEM

(71) Applicant: HITACHI CONSTRUCTION MACHINERY CO., LTD., Tokyo (JP)

(72) Inventors: Naoki Hayakawa, Ushiku (JP); Shiho Izumi, Hitachinaka (JP)

(73) Assignee: HITACHI CONSTRUCTION MACHINERY CO., LTD., Tokyo (JP)

( * ) Notice: Subject to any disclaimer, the term of this patent is extended or adjusted under 35 U.S.C. 154(b) by 308 days.

(21) Appl. No.: 18/022,776

(22) PCT Filed: Mar. 8, 2022

(86) PCT No.: PCT/JP2022/010148
§ 371 (c)(1),
(2) Date: Feb. 23, 2023

(87) PCT Pub. No.: WO2022/209646
PCT Pub. Date: Oct. 6, 2022

(65) Prior Publication Data

US 2023/0313503 A1 Oct. 5, 2023

(30) Foreign Application Priority Data

Mar. 31, 2021 (JP) ..... 2021-061875

(51) Int. Cl.
*E02F 9/26* (2006.01)

(52) U.S. Cl.
CPC ..... *E02F 9/261* (2013.01); *E02F 9/264* (2013.01)

(58) Field of Classification Search
CPC ..... E02F 9/261; E02F 9/264; E02F 9/2228
See application file for complete search history.

(56) References Cited

U.S. PATENT DOCUMENTS 6,085,583 A * 7/2000 Cannon ..... E02F 3/435 37/413
9,824,490 B1 * 11/2017 Côté ..... G06T 19/006
(Continued)

FOREIGN PATENT DOCUMENTS

JP 2005-011058 A 1/2005
JP 2014-205955 A 10/2014
(Continued)

OTHER PUBLICATIONS

International Search Report of PCT/JP2022/010148 dated May 31, 2022.
(Continued)

*Primary Examiner* — Redhwan K Mawari
(74) *Attorney, Agent, or Firm* — Mattingly & Malur, PC

(57) ABSTRACT

A work machine management system includes a terrain profile data generating system configured to generate terrain profile data representing a finished shape produced by a work device of a work machine, on the basis of a sensing result of a posture sensor that senses a posture of the work machine. The terrain profile data generating system computes a trajectory of the work device on the basis of the posture of the work machine, computes information about a plane constituting the trajectory of the work device on the basis of the trajectory, generates construction history data by recording positional information of the trajectory of the work device and the information about the plane constituting the trajectory for each of a plurality of grids obtained by dividing a predetermined area in a lattice manner, and generates the terrain profile data on the basis of the positional information of the trajectory of the work device and the information about the plane constituting the trajectory, the positional information and the plane information being included in the construction history data.

9 Claims, 21 Drawing Sheets

(56) References Cited

U.S. PATENT DOCUMENTS

| | | | | |
|---|---|---|---|---|
| 2004/0158355 | A1* | 8/2004 | Holmqvist | G05D 1/0236 701/23 |
| 2006/0026101 | A1* | 2/2006 | Ogura | E02F 9/26 705/50 |
| 2014/0324291 | A1* | 10/2014 | Jones | G01S 19/44 701/41 |
| 2016/0024757 | A1* | 1/2016 | Nomura | E02F 9/2054 701/32.3 |
| 2020/0277758 | A1* | 9/2020 | Edamura | E02F 9/2296 |
| 2021/0034058 | A1* | 2/2021 | Subramanian | G06T 17/05 |
| 2021/0131073 | A1* | 5/2021 | Wisley | E02F 9/262 |
| 2021/0363726 | A1* | 11/2021 | Aizawa | E02F 9/2041 |

FOREIGN PATENT DOCUMENTS

| | | | | | |
|---|---|---|---|---|---|
| JP | 2016-098535 | A | | 5/2016 | |
| JP | 2019190193 | A | * | 10/2019 | |
| JP | 2020033704 | A | * | 3/2020 | |
| JP | 2020-122371 | A | | 8/2020 | |
| JP | 2021-001436 | A | | 1/2021 | |
| WO | WO-2020026506 | A1 | * | 2/2020 | E02F 9/262 |

OTHER PUBLICATIONS

International Preliminary Report on Patentability received in corresponding International Application No. PCT/JP2022/010148 dated Oct. 12, 2023.

* cited by examiner

FIG. 9

| TIME | COORDINATES OF TRAJECTORY CONSTITUENT POINT | | | COMPLEMENTARY INFORMATION | | | OPERATION | TARGET SURFACE INTERVAL DISTANCE |
|---|---|---|---|---|---|---|---|---|
| | X | Y | Z | X | Y | Z | | |
| 11:10:21 | 402.5 | 1125.5 | 312.214 | 0.011 | 0.001 | 0.999 | EXCAVATION | 0.022 |
| 11:10:22 | 402.5 | 1125.5 | 312.216 | 0.012 | 0.001 | 0.999 | EXCAVATION | 0.023 |
| 11:10:23 | 402.5 | 1125.0 | 312.218 | 0.011 | 0.000 | 0.999 | EXCAVATION | 0.021 |
| 11:10:24 | 402.5 | 1125.0 | 312.217 | 0.010 | 0.001 | 0.999 | EXCAVATION | 0.025 |
| 11:10:25 | 402.5 | 1125.5 | 312.218 | 0.011 | 0.000 | 0.999 | EXCAVATION | 0.020 |
| 11:10:26 | 402.5 | 1125.5 | 312.219 | 0.011 | 0.001 | 0.999 | EXCAVATION | 0.023 |

FIG. 13

| TIME | COMPLEMENTARY INFORMATION | | | OPERATION | NUMBER OF RECORDED GRIDS | TRAJECTORY COORDINATES Gt ① | | | | TRAJECTORY COORDINATES Gt ② | | | |
|---|---|---|---|---|---|---|---|---|---|---|---|---|---|
| | X | Y | Z | | | X | Y | Z | DISTANCE ① | X | Y | Z | DISTANCE ② |
| 11:10:21 | 0.011 | 0.001 | 0.999 | EXCAVATION | 1 | 402.5 | 1125.5 | 312.214 | 0.022 | | | | |
| 11:10:22 | 0.012 | 0.001 | 0.999 | EXCAVATION | 2 | 402.5 | 1125.5 | 312.216 | 0.023 | 403.5 | 1126.5 | 312.316 | 0.024 |
| 11:10:23 | 0.011 | 0.000 | 0.999 | EXCAVATION | 2 | 402.5 | 1125.0 | 312.218 | 0.021 | 403.5 | 1126 | 312.318 | 0.022 |
| 11:10:24 | 0.010 | 0.001 | 0.999 | EXCAVATION | 3 | 402.5 | 1125.0 | 312.217 | 0.025 | 403.5 | 1126 | 312.317 | 0.026 |
| 11:10:25 | 0.011 | 0.000 | 0.999 | EXCAVATION | 2 | 402.5 | 1125.5 | 312.218 | 0.020 | 403.5 | 1126.5 | 312.318 | 0.021 |
| 11:10:26 | 0.011 | 0.001 | 0.999 | EXCAVATION | 1 | 402.5 | 1125.5 | 312.219 | 0.023 | | | | |

WORK MACHINE MANAGEMENT SYSTEM

TECHNICAL FIELD

The present invention relates to a work machine management system.

BACKGROUND ART

A work machine such as a hydraulic excavator having a machine control function and a machine guidance function is conventionally known. The machine control function is a function of controlling operations of a boom, an arm, and a bucket in such a manner that the bucket moves along a target surface created by three-dimensional CAD software or the like. The machine guidance function is a function of presenting, to an operator, information about the posture of the work machine, information about positional relation between the target surface on the periphery of the work machine and constituent elements of the work machine, and the like.

Recently, a move has spread to utilize construction history data in which three-dimensional positional information of the work machine computed to exert the machine control function and the machine guidance function is recorded together with time information. For example, terrain profile data may be generated on the basis of the construction history data, and the generated terrain profile data may be utilized to manage a finished amount of work by the work machine.

Patent Document 1 discloses a work support management system for a work machine, the system arranging a display table and a display content table in an excavation support database, storing a work area state of each mesh in the display table, storing an identification display method (display color) in the display content table in association with the state of each mesh, making the display content table refer to the state (height) of each mesh in the display table to read the corresponding display color, and making color-coded display of the work area state.

PRIOR ART DOCUMENT

Patent Document

Patent Document 1: JP-2005-11058-A

SUMMARY OF THE INVENTION

Problem to be Solved by the Invention

In the system described in Patent Document 1, a work area is expressed with meshes (square meshes having one side of 50 cm) representing a flat surface of a predetermined size as constituent units, and display processing and detailed data computation processing are performed for each mesh. However, because the meshes are set at equal intervals, when terrain profile data in the work area is generated, the terrain profile shape of a characteristic part such as a slope top or a slope toe of a slope face cannot be reproduced accurately depending on the position of the origin of the meshes, so that accuracy of the generated terrain profile data may be degraded. Incidentally, intervals between the meshes may be set finely in order to enhance the accuracy of the terrain profile data. However, in this case, the number of meshes (number of grids) is increased in proportion to the square of a reciprocal of the mesh interval (grid width), so that the amount of data to be managed is increased.

It is an object of the present invention to provide a work machine management system that can generate highly accurate terrain profile data while reducing the amount of data necessary to generate the terrain profile data.

Means for Solving the Problem

A work machine management system according to one aspect of the present invention includes a terrain profile data generating system configured to generate terrain profile data representing a finished shape produced by a work device of a work machine, on the basis of a sensing result of a posture sensor that senses a posture of the work machine. The terrain profile data generating system is configured to compute a trajectory of the work device on the basis of the posture of the work machine, compute information about a plane constituting the trajectory of the work device on the basis of the trajectory, generate construction history data by recording positional information of the trajectory of the work device and the information about the plane constituting the trajectory for each of a plurality of grids obtained by dividing a predetermined area in a lattice manner, and generate the terrain profile data on the basis of the positional information of the trajectory of the work device and the information about the plane constituting the trajectory, the positional information and the plane information being included in the construction history data.

Advantages of the Invention

According to the present invention, it is possible to provide a work machine management system that can generate highly accurate terrain profile data while reducing the amount of construction history data necessary to generate the terrain profile data.

BRIEF DESCRIPTION OF THE DRAWINGS

FIG. 9 is a diagram illustrating an example of construction history data.

FIG. 13 is a diagram illustrating an example of construction history data of a variable length.

MODES FOR CARRYING OUT THE INVENTION

A work machine management system according to an embodiment of the present invention will be described with reference to the drawings. A work machine is a machine used for various kinds of work such as civil engineering work, construction work, or demolition work. In the present embodiment, description will be made of an example in which the work machine is a crawler type hydraulic excavator 100.

Figure 1:
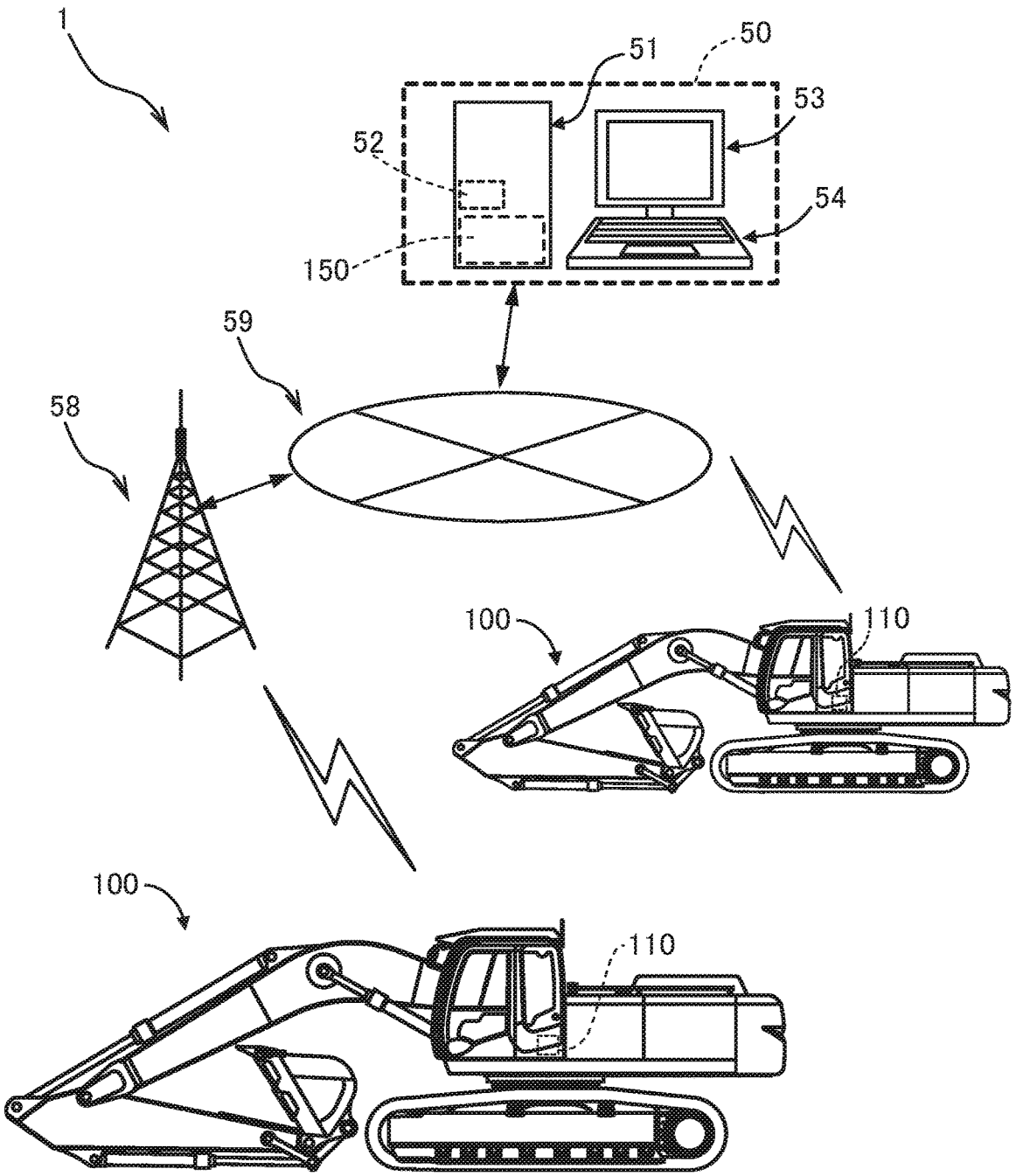
FIG. 1 is a diagram illustrating a configuration of a management system.

FIG. 1 is a diagram illustrating a configuration of a management system 1. As illustrated in FIG. 1, the management system 1 includes a machine controller 110 provided to the hydraulic excavator 100 that performs work on a work site and a management controller 150 provided to a management server 51. The management server 51 is disposed in a management center 50 installed on the work site or in a place separated from the work site. The management center 50 is, for example, installed in facilities such as a headquarter, a branch office, or a factory of a manufacturer (maker) of the hydraulic excavator 100, facilities of a rental company of the hydraulic excavator 100, a data center specializing in management of servers, or an owner owning the hydraulic excavator 100, or the like. The management server 51 is an external apparatus that remotely manages (grasps and monitors) the state of the hydraulic excavator 100.

The hydraulic excavator 100 and the management server 51 perform two-way communication via a communication line 59 of a wide area network. That is, the hydraulic excavator 100 and the management server 51 transmit and receive information (data) therebetween via the communication line 59. The communication line 59 is a mobile telephone communication network (mobile communication network) operated by a mobile telephone operator or the like, the Internet, or the like. In a case where the hydraulic excavator 100 and a radio base station 58 are connected to each other by the mobile telephone communication network (mobile communication network) as illustrated in the figure, for example, when the radio base station 58 receives predetermined information from the hydraulic excavator 100, the radio base station 58 transmits the received information to the management server 51 via the Internet.

The management server 51 receives the data received from the hydraulic excavator 100, and stores the received data in a storage device 52 such as a hard disk drive. The management server 51 causes the information (data) stored in the storage device 52 to be displayed on a display device 53 such as a liquid crystal display device. A manager can grasp the state of the hydraulic excavator 100 by operating the management server 51 with use of an input device 54 such as a keyboard and a mouse and causing the information of the predetermined hydraulic excavator 100 to be displayed on the display device 53.

Figure 2:
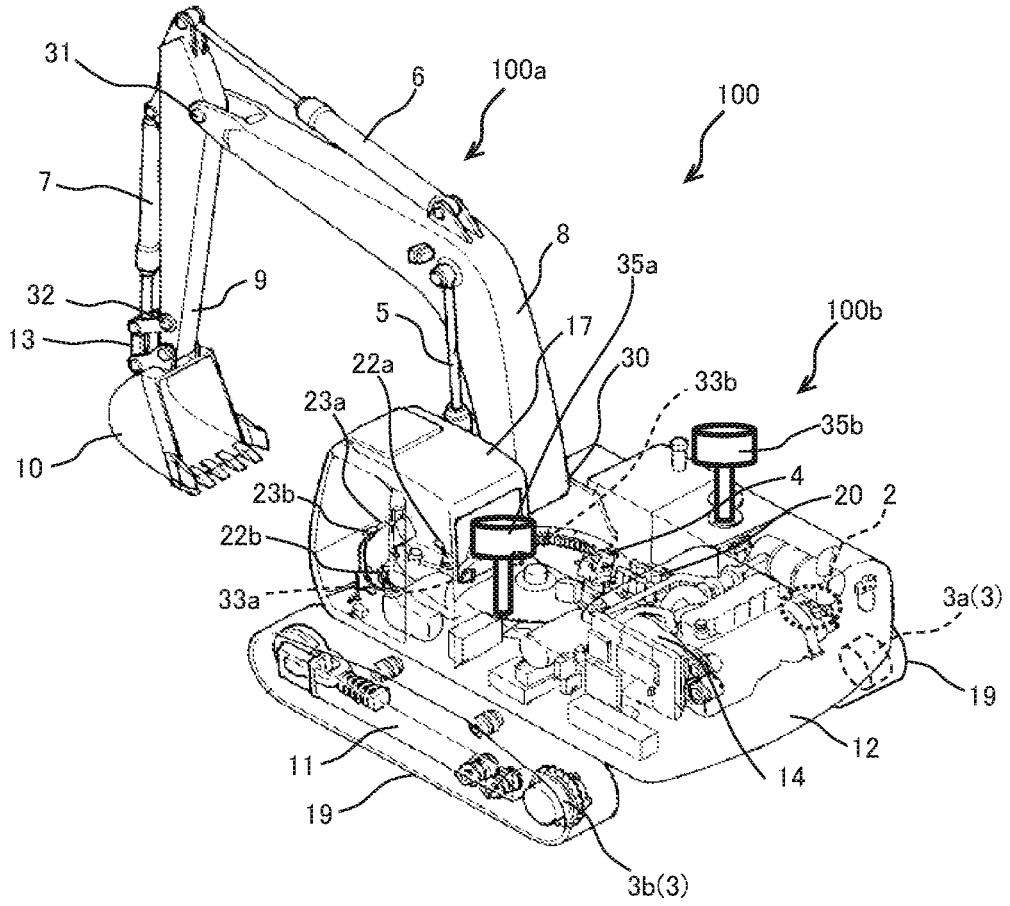
FIG. 2 is a configuration diagram of a hydraulic excavator.

FIG. 2 is a configuration diagram of the hydraulic excavator 100. As illustrated in FIG. 2, the hydraulic excavator 100 includes a machine body 100*b* and a work device 100*a* attached to the machine body 100*b*. The machine body 100*b* includes a track structure 11 and a swing structure 12 provided swingably on the track structure 11. The work device 100*a* is attached to a front portion of the swing structure 12. The hydraulic excavator 100 includes a left side travelling hydraulic motor 3*b* for driving a crawler 19 on the left side of the track structure 11 and a right side travelling hydraulic motor 3*a* for driving a crawler 19 on the right side of the track structure 11. The track structure 11 travels by driving the pair of left and right crawlers 19 by the travelling hydraulic motors 3 (3*a* and 3*b*). The hydraulic excavator 100 includes a swing hydraulic motor 4 for swinging (rotating) the swing structure 12 with respect to the track structure 11.

The work device 100*a* is an articulated work device including a plurality of driven members (front implement members) driven by a plurality of actuators. The work device 100*a* has a configuration in which three driven members (a boom 8, an arm 9, and a bucket 10) are coupled in series with each other. A proximal end portion of the boom 8 is rotatably coupled to the front portion of the swing structure 12 via a boom pin 91 (see FIG. 6). A proximal end portion of the arm 9 is rotatably coupled to a distal end portion of the boom 8 via an arm pin 92 (see FIG. 6). The bucket 10 is rotatably coupled to a distal end portion of the arm 9 via a bucket pin 93 (see FIG. 6). The boom pin 91, the arm pin 92, and the bucket pin 93 are arranged in parallel with each other, and the respective driven members (the boom 8, the arm 9, and the bucket 10) are rotatable relative to each other within a same plane.

The boom 8 is driven by a boom cylinder (hydraulic cylinder) 5 as an actuator. The arm 9 is driven by an arm cylinder (hydraulic cylinder) 6 as an actuator. The bucket 10 is driven by a bucket cylinder (hydraulic cylinder) 7 as an actuator. The hydraulic cylinders (5 to 7) each include a cylinder tube in a bottomed tubular shape having one end closed, a head cover that closes an opening at another end of the cylinder tube, a cylinder rod that penetrates the head cover and is inserted in the cylinder tube, and a piston that is provided to an end of the cylinder rod and divides the inside of the cylinder tube into a rod side hydraulic chamber and a bottom side hydraulic chamber. The boom cylinder 5 has one end side thereof coupled to the swing structure 12 and has another end side thereof coupled to the boom 8. The arm cylinder 6 has one end side thereof coupled to the boom 8 and has another end side thereof coupled to the arm 9. The bucket cylinder 7 has one end side thereof coupled to the arm 9 and has another end side thereof coupled to the bucket 10 via a bucket link 13. Work such as excavation, leveling, or the like of a natural ground is performed by driving each hydraulic cylinder (5 to 7).

A cab 17 to be boarded by an operator is provided on a left side of the front portion of the swing structure 12. The cab 17 is provided with a right travelling lever device 23*a* and a left travelling lever device 23*b* for giving operation instructions to the track structure 11. The cab 17 is also provided with a right control lever device 22*a* and a left control lever device 22*b* for giving operation instructions to the boom 8, the arm 9, the bucket 10, and the swing structure 12. The hydraulic excavator 100 according to the present embodiment thus includes operation devices (22*a*, 22*b*, 23*a*, and 23*b*) for operating the swing structure 12, the work device 100*a*, and the track structure 11.

The swing structure 12 is mounted with an engine 14 as a prime mover, a pump 2 driven by the engine 14, and a control valve unit 20. The control valve unit 20 has a plurality of flow control valves (referred to also as directional control valves), though not illustrated in the figure, and controls flows (flow rates and directions) of hydraulic operating fluid as working fluid supplied from the pump 2 to the actuators (the boom cylinder 5, the arm cylinder 6, the bucket cylinder 7, the swing hydraulic motor 4, and the travelling hydraulic motors 3).

Figure 3:
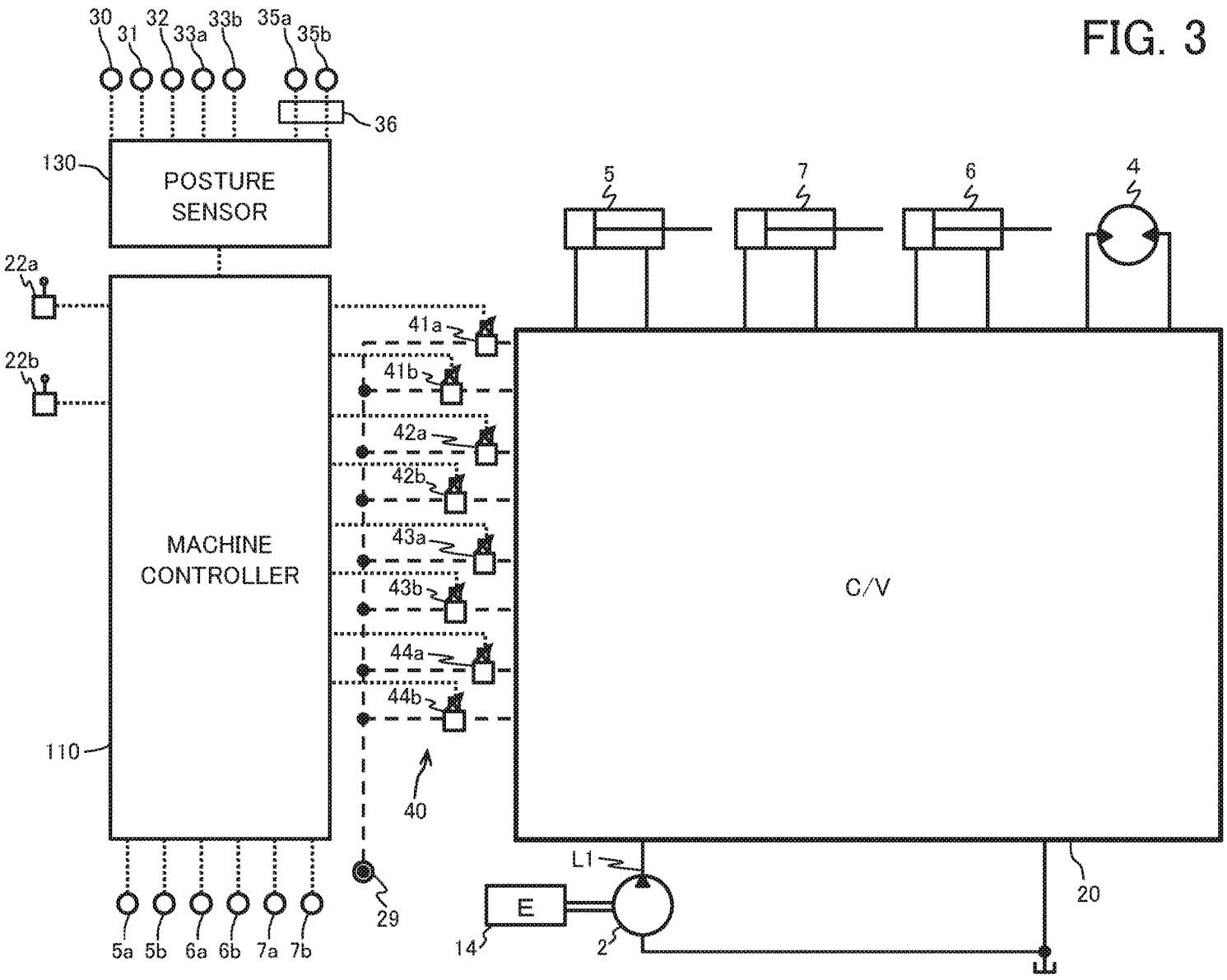
FIG. 3 is a diagram illustrating a configuration of a hydraulic drive system of the hydraulic excavator.

FIG. 3 is a diagram illustrating a configuration of a hydraulic drive system of the hydraulic excavator 100. Incidentally, for simplification of the description, FIG. 3 provides a configuration for driving the boom cylinder 5, the arm cylinder 6, the bucket cylinder 7, and the swing hydraulic motor 4 but does not illustrate circuits, valves, or the like not directly related to the present embodiment.

The pump 2 is driven by the engine 14 to suck in the hydraulic operating fluid from a tank and deliver the hydraulic operating fluid to a pump line L1 that connects the control valve unit 20 and a delivery port of the pump 2 to each other. Incidentally, FIG. 3 illustrates an example in which the pump 2 is a hydraulic pump of a fixed displacement type. However, a hydraulic pump of a variable displacement type may be adopted. In addition, there may be one or a plurality of pumps 2 that supply the hydraulic operating fluid to the control valve unit 20.

The control valve unit 20 controls flows of the hydraulic operating fluid (hydraulic fluid) supplied from the pump 2 to the actuators by being controlled by a solenoid valve unit 40 including a plurality of solenoid proportional valves 41*a* to 44*b*. The control valve unit 20 controls the flow of the hydraulic operating fluid (hydraulic fluid) supplied from the pump 2 to the boom cylinder 5, according to signal pressures generated by the solenoid proportional valves 41*a* and 41*b*. The control valve unit 20 controls the flow of the hydraulic operating fluid (hydraulic fluid) supplied from the pump 2 to the arm cylinder 6, according to signal pressures generated by the solenoid proportional valves 42*a* and 42*b*. The control valve unit 20 controls the flow of the hydraulic operating fluid (hydraulic fluid) supplied from the pump 2 to the bucket cylinder 7, according to signal pressures generated by the solenoid proportional valves 43*a* and 43*b*. The control valve unit 20 controls the flow of the hydraulic operating fluid (hydraulic fluid) supplied from the pump 2 to the swing hydraulic motor 4, according to signal pressures generated by the solenoid proportional valves 44*a* and 44*b*.

The solenoid proportional valves 41*a* to 44*b* use pilot hydraulic fluid supplied from a pilot hydraulic fluid source 29 as a primary pressure (source pressure) and outputs a secondary pressure generated by pressure reduction according to a command current from a valve driving device 158 (see FIG. 4) controlled by the machine controller 110, as a signal pressure to the control valve unit 20. Incidentally, the pilot hydraulic fluid source 29 is, for example, a hydraulic pump (pilot pump) driven by the engine 14.

The right control lever device 22*a* has an operation sensor that outputs a voltage signal (operation signal) corresponding to an operation amount and an operation direction of the control lever as boom operation information and bucket operation information to the machine controller 110. The left control lever device 22*b* has an operation sensor that outputs a voltage signal (operation signal) corresponding to an operation amount and an operation direction of the control lever as arm operation information and swing operation information to the machine controller 110.

When the operation signals are input from the operation sensors of the operation devices 22*a* and 22*b* to the machine controller 110, the machine controller 110 controls the solenoid proportional valves 41*a* to 44*b* of the solenoid valve unit 40 in such a manner that the actuators operate at operation velocities corresponding to the operation signals. Consequently, the control valve unit 20 is controlled to supply the hydraulic operating fluid delivered from the pump 2 to the actuators, and the actuators operate.

When a boom raising operation is performed by the operation device 22*a*, a command pressure corresponding to the operation amount of the boom raising operation is output from the solenoid proportional valve 41*a* to a first pressure receiving portion of a flow control valve for the boom, and the flow control valve for the boom operates to one side (boom raising side). Consequently, the hydraulic operating fluid is supplied to the bottom side hydraulic chamber of the boom cylinder 5, and the hydraulic operating fluid is discharged from the rod side hydraulic chamber of the boom cylinder 5 to the tank. As a result, the boom cylinder 5 extends, and the boom 8 rotates upward with the boom pin 91 as a pivot. When a boom lowering operation is performed by the operation device 22*a*, a command pressure corresponding to the operation amount of the boom lowering operation is output from the solenoid proportional valve 41*b* to a second pressure receiving portion of the flow control valve for the boom, and the flow control valve for the boom operates to another side (boom lowering side). Consequently, the hydraulic operating fluid is supplied to the rod side hydraulic chamber of the boom cylinder 5, and the hydraulic operating fluid is discharged from the bottom side hydraulic chamber of the boom cylinder 5 to the tank. As a result, the boom cylinder 5 contracts, and the boom 8 rotates downward with the boom pin 91 as a pivot.

When a bucket crowding operation is performed by the operation device 22*a*, a command pressure corresponding to the operation amount of the bucket crowding operation is output from the solenoid proportional valve 43*a* to a first pressure receiving portion of a flow control valve for the bucket, and the flow control valve for the bucket operates to one side (bucket crowding side). Consequently, the hydraulic operating fluid is supplied to the bottom side hydraulic chamber of the bucket cylinder 7, and the hydraulic operating fluid is discharged from the rod side hydraulic chamber of the bucket cylinder 7 to the tank. As a result, the bucket cylinder 7 extends, and the bucket 10 rotates downward with the bucket pin 93 as a pivot. That is, a bucket crowding operation is performed. When a bucket dumping operation is performed by the operation device 22*a*, a command pressure corresponding to the operation amount of the bucket dumping operation is output from the solenoid proportional valve 43*b* to a second pressure receiving portion of the flow control valve for the bucket, and the flow control valve for the bucket operates to another side (bucket dumping side). Consequently, the hydraulic operating fluid is supplied to the rod side hydraulic chamber of the bucket cylinder 7, and the hydraulic operating fluid is discharged from the bottom side hydraulic chamber of the bucket cylinder 7 to the tank. As a result, the bucket cylinder 7 contracts, and the bucket 10 rotates upward with the bucket pin 93 as a pivot. That is, a bucket dumping operation is performed.

When an arm crowding operation is performed by the operation device 22*b*, a command pressure corresponding to the operation amount of the arm crowding operation is output from the solenoid proportional valve 42*a* to a first pressure receiving portion of a flow control valve for the arm, and the flow control valve for the arm operates to one side (arm crowding side). Consequently, the hydraulic operating fluid is supplied to the bottom side hydraulic chamber of the arm cylinder 6, and the hydraulic operating fluid is discharged from the rod side hydraulic chamber of the arm cylinder 6 to the tank. As a result, the arm cylinder 6 extends, and the arm 9 rotates downward with the arm pin 92 as a pivot. That is, an arm crowding operation is performed. When an arm dumping operation is performed by the operation device 22*b*, a command pressure corresponding to the operation amount of the arm dumping operation is output from the solenoid proportional valve 42*b* to a second pressure receiving portion of the flow control valve for the arm, and the flow control valve for the arm operates to another side (arm dumping side). Consequently, the hydraulic operating fluid is supplied to the rod side hydraulic chamber of the arm cylinder 6, and the hydraulic operating fluid is discharged from the bottom side hydraulic chamber of the arm cylinder 6 to the tank. As a result, the arm cylinder 6 contracts, and the arm 9 rotates upward with the arm pin 92 as a pivot. That is, an arm dumping operation is performed.

When the driven members (8, 9, and 10) are rotated by the operations of the actuators (5, 6, and 7), the posture of the work device 100*a* and the position of a claw tip of the bucket 10 or the like change.

When a right swing operation is performed by the operation device 22*b*, a command pressure corresponding to the operation amount of the right swing operation is output from the solenoid proportional valve 44*a* to a first pressure receiving portion of a flow control valve for swinging, and the flow control valve for swinging operates to one side (right swing side). Consequently, the hydraulic operating fluid is supplied to the swing hydraulic motor 4, and the swing hydraulic motor 4 rotates in one direction (right swing direction). As a result, the swing structure 12 swings in a right direction with respect to the track structure 11. When a left swing operation is performed by the operation device 22*b*, a command pressure corresponding to the operation amount of the left swing operation is output from the solenoid proportional valve 44*b* to a second pressure receiving portion of the flow control valve for swinging, and the flow control valve for swinging operates to another side (left swing side). Consequently, the hydraulic operating fluid is supplied to the swing hydraulic motor 4, and the swing hydraulic motor 4 rotates in another direction (left swing direction). As a result, the swing structure 12 swings in a left direction with respect to the track structure 11. When the swing structure 12 is caused to swing with respect to the track structure 11 by the operations of the swing hydraulic motor 4, the position of the claw tip of the bucket 10 or the like changes.

The hydraulic excavator 100 includes pressure sensors 5*a* to 7*b* that sense pressures (cylinder pressures) within the boom cylinder 5, the arm cylinder 6, and the bucket cylinder 7 and output the sensing results (electric signals) to the machine controller 110. The pressure sensor 5*a* senses the pressure of the rod side hydraulic chamber of the boom cylinder 5, and the pressure sensor 5*b* senses the pressure of the bottom side hydraulic chamber of the boom cylinder 5. The pressure sensor 6*a* senses the pressure of the rod side hydraulic chamber of the arm cylinder 6, and the pressure sensor 6*b* senses the pressure of the bottom side hydraulic chamber of the arm cylinder 6. The pressure sensor 7*a* senses the pressure of the rod side hydraulic chamber of the bucket cylinder 7, and the pressure sensor 7*b* senses the pressure of the bottom side hydraulic chamber of the bucket cylinder 7.

As illustrated in FIG. 2, a boom angle sensor 30 for measuring a rotational angle $\alpha$ of the boom 8 (hereinafter written as a boom angle) (see FIG. 6) with respect to the swing structure 12 is attached to the boom pin 91. An arm angle sensor 31 for measuring a rotational angle $\beta$ of the arm 9 (hereinafter written as an arm angle) (see FIG. 6) with respect to the boom 8 is attached to the arm pin 92. A bucket angle sensor 32 for measuring a rotational angle $\gamma$ of the bucket 10 (hereinafter written as a bucket angle) (see FIG. 6) with respect to the arm 9 is attached to the bucket link 13. Attached to the swing structure 12 is a machine body longitudinal inclination angle sensor 33*a* for measuring an angle $\theta p$ of inclination (hereinafter written as a pitch angle) (see FIG. 6) in a forward-rearward direction of the swing structure 12 (machine body 100*b*) with respect to a reference plane (for example, a horizontal plane). In addition, attached to the swing structure 12 is a machine body lateral inclination angle sensor 33*b* for measuring an angle $\theta r$ of inclination (hereinafter written as a roll angle) (not illustrated) in a left-right direction of the swing structure 12 (machine body 100*b*) with respect to the reference plane (for example, the horizontal plane).

A sensor such as an IMU (Inertial Measurement Unit), a potentiometer, or a rotary encoder can be employed as the angle sensors 30, 31, 32, 33*a*, and 33*b*. Incidentally, the bucket angle sensor 32 may be attached to the bucket 10 rather than to the bucket link 13.

The hydraulic excavator 100 includes a pair of left and right antennas for RTK-GNSS (Real Time Kinematic-Global Navigation Satellite Systems) (a first GNSS antenna 35*a* and a second GNSS antenna 35*b*) on the swing structure 12 and a GNSS receiving device 36 (see FIG. 3 and FIG. 5) that is mounted within the cab 17 and computes positional information of the hydraulic excavator 100 by using radio waves received by the GNSS antennas 35*a* and 35*b*.

The angle sensors 30, 31, 32, 33*a*, and 33*b* and the GNSS antennas 35*a* and 35*b* function as posture sensors that sense the posture of the hydraulic excavator 100. In addition, the GNSS antennas 35*a* and 35*b* function as position sensors that sense the position of the hydraulic excavator 100.

As illustrated in FIG. 3, the hydraulic excavator 100 includes a posture sensor 130 that senses (computes) the position and orientation of the hydraulic excavator 100 and the posture of the hydraulic excavator 100 (the posture of the work device 100*a* and the posture of the machine body 100*b*) on the basis of sensing results in the boom angle sensor 30, the arm angle sensor 31, the bucket angle sensor 32, the machine body longitudinal inclination angle sensor 33*a*, and the machine body lateral inclination angle sensor 33*b* as well as positional information from the GNSS antennas 35*a* and 35*b*.

The posture sensor 130 computes the position of the hydraulic excavator 100 in a site coordinate system as well as a boom angle α, an arm angle β, a bucket angle γ, a pitch angle θp, a roll angle θr, and an azimuth angle θy as posture information indicating the posture of the hydraulic excavator 100 and outputs the position and the angles to the machine controller 110.

Figure 4:
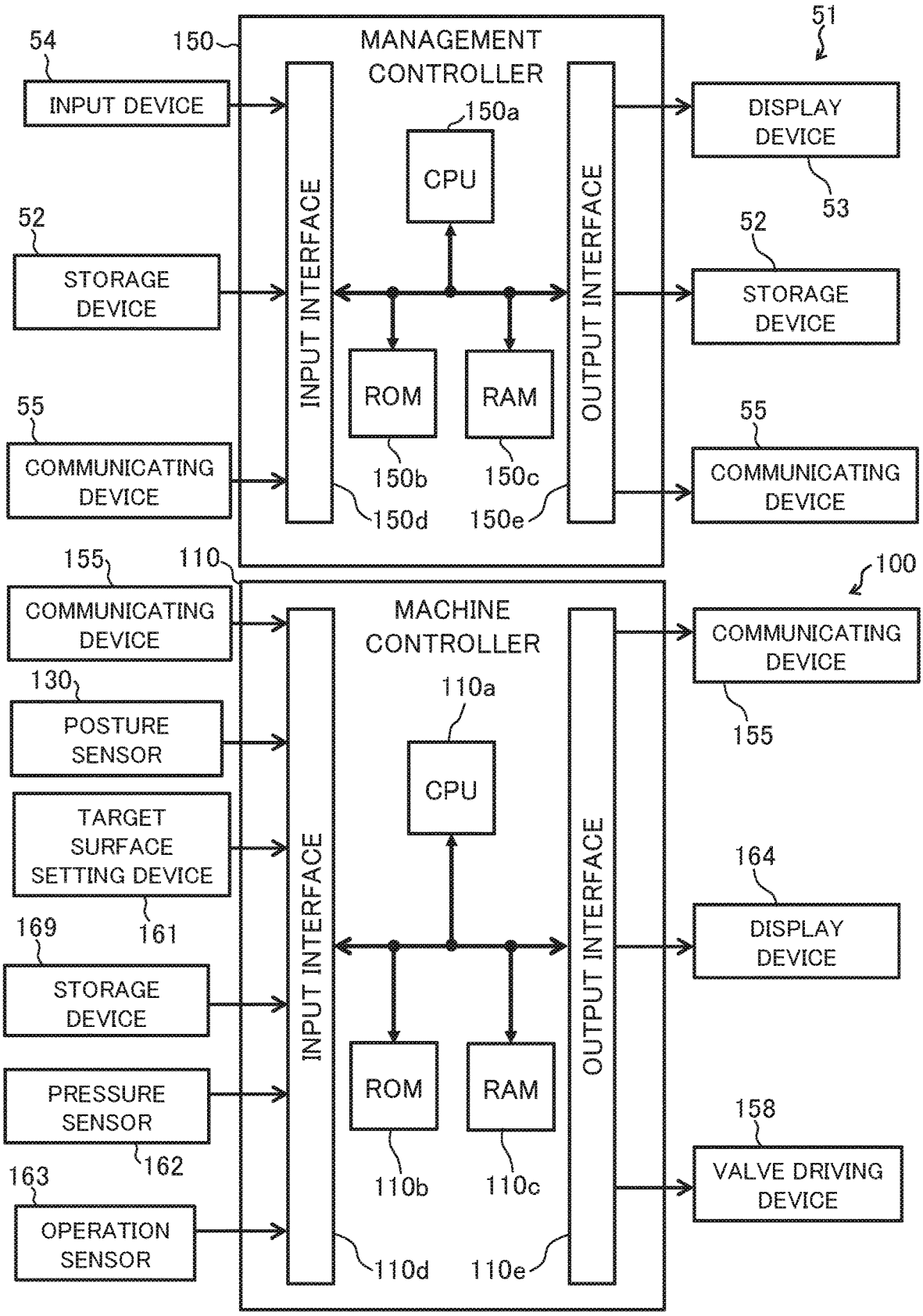
FIG. 4 is a diagram of a hardware configuration of a machine controller of the hydraulic excavator and a management controller of a management server.

FIG. 4 is a diagram of a hardware configuration of the machine controller 110 of the hydraulic excavator 100 and the management controller 150 of the management server 51.

The hydraulic excavator 100 includes the machine controller 110, a communicating device 155 for communicating with the management server 51, the posture sensor 130 that senses (computes) the posture of the hydraulic excavator 100, a target surface setting device 161 that sets a target surface St (see FIG. 6), a pressure sensor 162 that senses the pressures of the hydraulic cylinders (5 to 7), and a storage device 169 that stores information.

The communicating device 155 is a wireless communication device capable of wireless communication with the radio base station 58 connected to the communication line 59 as a wide area network. The communicating device 155 has a communication interface including a communication antenna having a predetermined frequency band as a sensing band. Incidentally, the communicating device 155 may send and receive information to and from the management server 51 directly or indirectly by using a communication system such as Wi-Fi (registered trademark), ZigBee (registered trademark), or Bluetooth (registered trademark).

The target surface setting device 161 is a device capable of inputting, to the machine controller 110, information about the target surface St (see FIG. 6) (positional information of one or a plurality of target surfaces, information about an angle(s) of inclination of the target surface(s) with respect to the reference plane (horizontal plane), and the like). The target surface setting device 161 is connected to an external terminal (not illustrated) that stores three-dimensional data of the target surface defined in the site coordinate system. In the present embodiment, a sectional shape obtained by sectioning the target surface of the three-dimensional data obtained from the external terminal by a plane in which the work device 100*a* moves (operation plane of the work device) is used as the target surface St (two-dimensional target surface). Incidentally, the input of the target surface St via the target surface setting device 161 may manually be performed by the operator. In addition, data exchange between the target surface setting device 161 and the machine controller 110 may be performed by wire communication, may be performed by wireless communication, or may be performed via a recording medium such as a USB flash memory or an SD card.

The pressure sensor 162 includes the pressure sensors 5*a* to 7*b*. The pressure sensor 162 senses the pressures of the rod side hydraulic chambers and the bottom side hydraulic chambers of the hydraulic cylinders 5 to 7 that drive the driven members of the work device 100*a*, and outputs the sensing results to the machine controller 110. An operation sensor 163 includes the operation sensors of the operation devices 22*a* and 22*b*. The operation sensor 163 senses operation amounts and operation directions of the operation devices 22*a* and 22*b* and outputs the sensing results to the machine controller 110.

Figure 6:
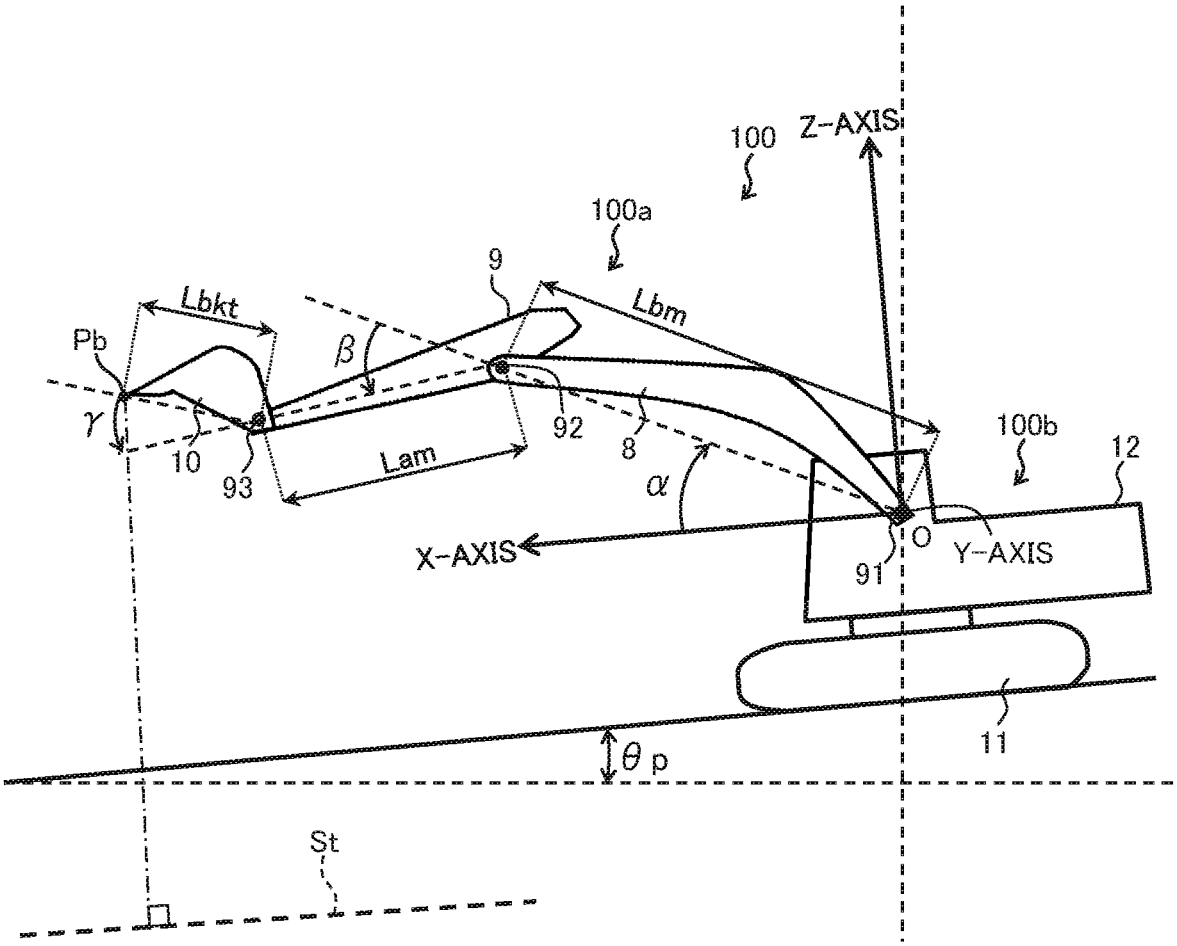
FIG. 6 is a diagram illustrating an excavator reference coordinate system.

The storage device 169 is a nonvolatile memory such as a flash memory or a hard disk drive. The storage device 169 stores, as dimensional information of the hydraulic excavator 100, a length Lbm from a central position of the boom pin 91 to a central position of the arm pin 92, a length Lam from the central position of the arm pin 92 to a central position of the bucket pin 93, and a length Lbkt from the central position of the bucket pin 93 to a claw tip Pb of the bucket 10, as illustrated in FIG. 6. In addition, the storage device 169 stores, as dimensional information of the hydraulic excavator 100, information about attachment positions of the hydraulic cylinders (5 to 7) (for example, a distance from the boom pin 91 to a rod side connecting portion of the boom cylinder 5, a distance from the boom pin 91 to a bottom side connecting portion of the boom cylinder 5, and the like). Further, the storage device 169 stores position coordinates in an excavator reference coordinate system of the GNSS antennas 35*a* and 35*b*. Incidentally, the position coordinates in the excavator reference coordinate system of the GNSS antennas 35*a* and 35*b* can be computed on the basis of design dimensions or a result of measurement by a measuring instrument such as a total station.

A display device 164 illustrated in FIG. 4 is a liquid crystal display device that causes a display image to be displayed on a display screen thereof on the basis of a display control signal output from the machine controller 110. The valve driving device 158 controls command currents supplied to solenoids of the solenoid proportional valves 41*a* to 44*b* of the solenoid valve unit 40, on the basis of valve driving signals output from the machine controller 110.

The management server 51 includes the management controller 150, a communicating device 55 for communicating with the hydraulic excavator 100, the input device 54 such as a keyboard and a mouse for inputting predetermined information to the management controller 150 according to operation of the manager, the display device 53 such as a liquid crystal display device, and the storage device 52 that stores information.

The communicating device 55 is a communicating device capable of communicating with the hydraulic excavator 100 via the communication line 59 as a wide area network. Incidentally, the communicating device 55 may send and receive information to and from the hydraulic excavator 100 directly or indirectly by using a communication system such as Wi-Fi (registered trademark), ZigBee (registered trademark), or Bluetooth (registered trademark).

The machine controller 110 and the management controller 150 are constituted by microcomputers including CPUs (Central Processing Units) 110*a* and 150*a* as operating circuits, ROMs (Read Only Memories) 110*b* and 150*b* and RAMs (Random Access Memories) 110*c* and 150*c* as storage devices, and input interfaces 110*d* and 150*d* and output interfaces 110*e* and 150*e* as well as other peripheral circuits. Each of the machine controller 110 and the management controller 150 may be constituted by one computer or may be constituted by a plurality of computers.

The input interfaces 110*d* and 150*d* convert signals from various kinds of devices in such a manner as to enable the CPUs 110*a* and 150*a* to perform computation on the signals. The ROMs 110*b* and 150*b* are nonvolatile memories such as EEPROMs. The ROMs 110*b* and 150*b* store a program that can perform various kinds of computation as indicated in a flowchart to be described later by the CPUs 110*a* and 150*a*. That is, the ROMs 110*b* and 150*b* are storage media from which the program that implements functions of the present embodiment is readable.

The RAMs 110*c* and 150*c* are volatile memories and are work memories between which and the CPUs 110*a* and 150*a* data input and output are directly performed. The RAMs

110*c* and 150*c* temporarily store necessary data while the CPUs 110*a* and 150*a* compute and execute the program.

The CPUs 110*a* and 150*a* are computing devices that expand the program stored in the ROMs 110*b* and 150*b* into the RAMs 110*c* and 150*c* to compute and execute the program. The CPUs 110*a* and 150*a* perform predetermined computation processing on signals taken in from the input interfaces 110*d* and 150*d*, the ROMs 110*b* and 150*b*, and the RAMs 110*c* and 150*c* according to the program. The output interfaces 110*e* and 150*e* generate signals for output according to results of computation in the CPU 110*a* and output the signals to various kinds of devices.

Figure 5:
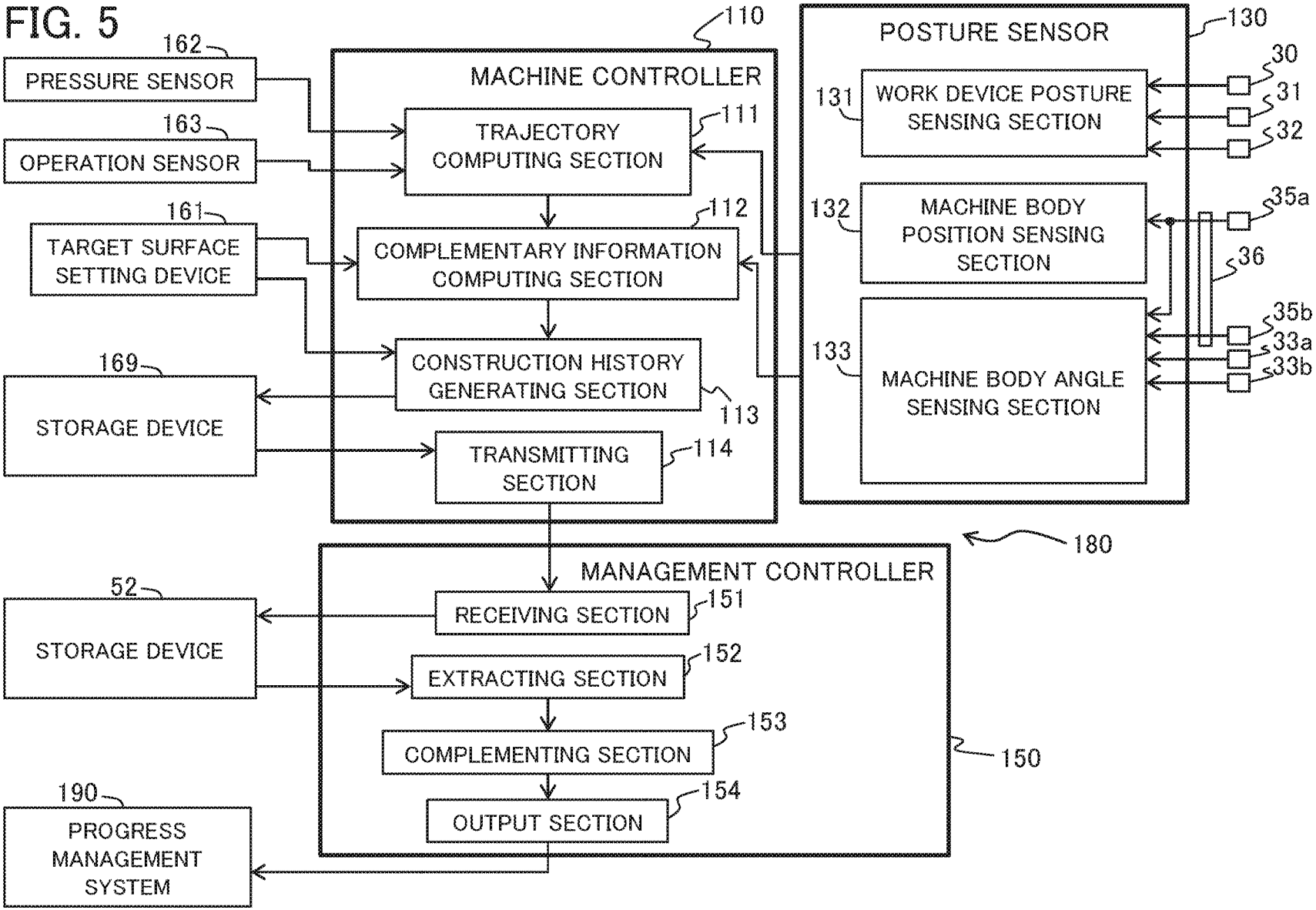
FIG. 5 is a functional block diagram illustrating main functions of a terrain profile data generating system.

Referring to FIG. 5, description will be made of a terrain profile data generating system 180 that generates terrain profile data representing a finished shape produced by the work device 100*a* of the hydraulic excavator 100. FIG. 5 is a functional block diagram illustrating main functions of the terrain profile data generating system 180. As illustrated in FIG. 5, the terrain profile data generating system 180 includes the machine controller 110 as a first processing apparatus that performs processing of generating construction history data on the basis of the posture of the hydraulic excavator 100 sensed by the posture sensor 130, and the management controller 150 as a second processing apparatus that performs processing of generating the terrain profile data on the basis of the construction history data.

As illustrated in FIG. 5, the posture sensor 130 functions as a work device posture sensing section 131, a machine body position sensing section 132, and a machine body angle sensing section 133. The work device posture sensing section 131 computes the boom angle α, the arm angle and the bucket angle γ on the basis of results of sensing in the boom angle sensor 30, the arm angle sensor 31, and the bucket angle sensor 32 and outputs the computation results to the machine controller 110.

The machine body position sensing section 132 computes antenna positional information in the site coordinate system on the basis of the positional information of the first GNSS antenna 35*a* output from the GNSS receiving device 36. The machine body position sensing section 132 outputs the antenna positional information to the machine controller 110. When positional information in a coordinate system other than the site coordinate system is input to the machine body position sensing section 132, the machine body position sensing section 132 performs coordinate transformation processing that transforms the positional information in the coordinate system into positional information in the site coordinate system, and computes the antenna positional information in the site coordinate system.

In the present embodiment, description will be made of a case where the GNSS receiving device 36 outputs a coordinate value in the site coordinate system. Incidentally, it suffices for the GNSS receiving device 36 to be able to output coordinate values in at least one of a geographic coordinate system, a plane rectangular coordinate system, a geocentric rectangular coordinate system, or the site coordinate system. Coordinate values in the geographic coordinate system include a latitude, a longitude, and an ellipsoidal height. Coordinate values in the plane rectangular coordinate system, the geocentric rectangular coordinate system, and the site coordinate system are those of a three-dimensional rectangular coordinate system including X-, Y-, and Z-coordinates or the like. Coordinate values in the geographic coordinate system can be transformed into a three-dimensional rectangular coordinate system such as the plane rectangular coordinate system by using Gauss-Kruger isometric projection or the like. In addition, the plane rectangular coordinate system, the geocentric rectangular coordinate system, and the site coordinate system can mutually be transformed by using affine transformation, Helmert transformation, or the like.

The site coordinate system in the present embodiment is a coordinate system that has, as an origin, a freely-selected position on a work site and has an E-axis in an east direction on the horizontal plane, an N-axis in a north direction on the horizontal plane, and an H-axis in a vertically upward direction.

The machine body angle sensing section 133 computes the azimuth angle θy, the pitch angle θp, and the roll angle θr on the basis of antenna positional information output by the first GNSS antenna 35*a* and the second GNSS antenna 35*b* and results of sensing (sensor values) in the machine body longitudinal inclination angle sensor 33*a* and the machine body lateral inclination angle sensor 33*b*. The machine body angle sensing section 133 outputs the computation results to the machine controller 110. The machine body angle sensing section 133 computes the azimuth angle θy from positional relation between the first GNSS antenna 35*a* and the second GNSS antenna 35*b*.

The machine controller (first processing apparatus) 110 of the hydraulic excavator 100 performs processing of generating construction history data on the basis of the posture of the hydraulic excavator 100 sensed by the posture sensor 130, and transmitting the generated construction history data to the management server 51 outside the hydraulic excavator 100. In the following, functions of the machine controller 110 will be described in detail.

The machine controller 110 functions as a trajectory computing section 111, a complementary information computing section 112, a construction history generating section 113, and a transmitting section 114. The trajectory computing section 111 computes the trajectory of the bucket 10 on the basis of pressure information from the pressure sensor 162, operation information from the operation sensor 163, and posture information (angle information) from the posture sensor 130.

In an "excavating operation" in which a natural ground is excavated by the bucket 10, the trajectory of the bucket 10 is the movement trajectory of the claw tip of the bucket 10 which claw tip is in contact with the ground. In a "compacting operation" in which the ground is compacted by a back surface of the bucket 10 by moving the bucket 10 forward, the trajectory of the bucket 10 is the movement trajectory of a specific part on the back surface of the bucket 10 which part is in contact with the ground. In a "bumping operation" in which the bucket 10 is struck against the ground, the trajectory of the bucket 10 corresponds to a bottom surface of the bucket 10 at a moment at which the bucket 10 is struck against the ground.

In the compacting operation, the "specific part on the back surface of the bucket 10" which part is in contact with the ground differs according to the shape of the bucket 10. For example, in a bucket in which the back surface and the bottom surface of the bucket are not smoothly connected to each other, as in a slope finishing bucket, an end portion of the bottom surface of the bucket on an opposite side from the claw tip is preferably set as the specific part on the back surface in advance. On the other hand, in a bucket in which the back surface and the bottom surface of the bucket are smoothly connected to each other and the back surface of the bucket 10 is a curved surface, as in an ordinary bucket, the part in contact with the ground differs according to the shape of the bucket 10. It is therefore preferable to perform the compacting operation experimentally before work, confirm the part at which the bucket 10 is in contact with the ground, and set the specific part on the back surface of the bucket 10 in advance.

The trajectory computing section 111 determines whether or not the hydraulic excavator 100 is performing the excavating operation, on the basis of the operation information from the operation sensor 163 and the pressure information from the pressure sensor 162. In the excavating operation, an arm pulling operation is performed, and the bucket 10 is in contact with the ground.

The trajectory computing section 111 determines that the arm pulling operation is being performed, when an arm pulling operation amount of the left control lever device 22*b* is equal to or more than an operation amount threshold value La1 set in advance. The trajectory computing section 111 determines that the arm pulling operation is not being performed, when the arm pulling operation amount is less than the operation amount threshold value La1. The operation amount threshold value La1 is a threshold value for determining whether or not the left control lever device 22*b* is operated in an arm pulling direction, and is stored in the ROM 110*b* in advance.

The trajectory computing section 111 determines that the bucket 10 is in contact with the ground, when a pressure Pab of the bottom side hydraulic chamber of the arm cylinder 6 is equal to or more than a pressure threshold value Pab0. The trajectory computing section 111 determines that the bucket 10 is not in contact with the ground, when the pressure Pab of the bottom side hydraulic chamber of the arm cylinder 6 is less than the pressure threshold value Pab0. The pressure threshold value Pab0 is a threshold value for determining whether or not the bucket 10 is in contact with the ground in excavation work using the arm pulling operation, and is stored in the ROM 110*b* in advance. When the arm cylinder 6 operates in an extending direction, and the bucket 10 comes into contact with the ground, the pressure of the bottom side hydraulic chamber of the arm cylinder 6 rises. It is therefore possible to determine whether or not the excavating operation is being performed, by monitoring the pressure of the bottom side hydraulic chamber of the arm cylinder 6.

The trajectory computing section 111 determines that the hydraulic excavator 100 is performing the excavating operation, when the arm pulling operation amount of the left control lever device 22*b* is equal to or more than the operation amount threshold value La1 and the pressure Pab of the bottom side hydraulic chamber of the arm cylinder 6 is equal to or more than the pressure threshold value Pab0. The trajectory computing section 111 determines that the hydraulic excavator 100 is not performing the excavating operation, when the arm pulling operation amount of the left control lever device 22*b* is less than the operation amount threshold value La1 or when the pressure Pab of the bottom side hydraulic chamber of the arm cylinder 6 is less than the pressure threshold value Pab0.

The trajectory computing section 111 determines whether or not the hydraulic excavator 100 is performing the compacting operation, on the basis of the operation information from the operation sensor 163 and the pressure information from the pressure sensor 162. In the compacting operation, an arm pushing operation is performed, and the bucket 10 is in contact with the ground.

The trajectory computing section 111 determines that the arm pushing operation is being performed, when an arm pushing operation amount of the left control lever device 22*b* is equal to or more than an operation amount threshold value La2 set in advance. The trajectory computing section 111 determines that the arm pushing operation is not being performed, when the arm pushing operation amount is less than the operation amount threshold value La2. The operation amount threshold value La2 is a threshold value for determining whether or not the left control lever device 22*b* is operated in an arm pushing direction, and is stored in the ROM 110*b* in advance.

The trajectory computing section 111 determines that the bucket 10 is in contact with the ground, when a pressure Par of the rod side hydraulic chamber of the arm cylinder 6 is equal to or more than a pressure threshold value Par0. The trajectory computing section 111 determines that the bucket 10 is not in contact with the ground, when the pressure Par of the rod side hydraulic chamber of the arm cylinder 6 is less than the pressure threshold value Par0. The pressure threshold value Par0 is a threshold value for determining whether or not the bucket 10 is in contact with the ground in compacting work using the arm pushing operation, and is stored in the ROM 110*b* in advance. When the arm cylinder 6 operates in a contracting direction, and the bucket 10 is in contact with the ground, the pressure of the rod side hydraulic chamber of the arm cylinder 6 rises. It is therefore possible to determine whether or not the compacting operation is being performed, by monitoring the pressure of the rod side hydraulic chamber of the arm cylinder 6.

The trajectory computing section 111 determines that the hydraulic excavator 100 is performing the compacting operation, when the arm pushing operation amount of the left control lever device 22*b* is equal to or more than the operation amount threshold value La2 and the pressure Par of the rod side hydraulic chamber of the arm cylinder 6 is equal to or more than the pressure threshold value Par0. The trajectory computing section 111 determines that the hydraulic excavator 100 is not performing the compacting operation, when the arm pushing operation amount of the left control lever device 22*b* is less than the operation amount threshold value La2 or when the pressure Par of the rod side hydraulic chamber of the arm cylinder 6 is less than the pressure threshold value Par0.

The trajectory computing section 111 determines whether or not the hydraulic excavator 100 is performing the bumping operation, on the basis of the operation information from the operation sensor 163 and the pressure information from the pressure sensor 162. In the bumping operation, a boom lowering operation is performed, and the bucket 10 comes into contact with the ground and presses the ground.

The trajectory computing section 111 determines that the boom lowering operation is being performed, when a boom lowering operation amount of the right control lever device 22*a* is equal to or more than an operation amount threshold value Lb1 set in advance. The trajectory computing section 111 determines that the boom lowering operation is not being performed, when the boom lowering operation amount is less than the operation amount threshold value Lb1. The operation amount threshold value Lb1 is a threshold value for determining whether or not the right control lever device 22*a* is operated in a boom lowering direction, and is stored in the ROM 110*b* in advance.

The trajectory computing section 111 determines that the bucket 10 is in contact with the ground and is pressing the ground, when a pressure Pbr of the rod side hydraulic chamber of the boom cylinder 5 is equal to or more than a pressure threshold value Pbr0. The trajectory computing section 111 determines that the bucket 10 is not pressing the ground, when the pressure Pbr of the rod side hydraulic chamber of the boom cylinder 5 is less than the pressure threshold value Pbr0. The pressure threshold value Pbr0 is a threshold value for determining whether or not the bucket 10 is pressing the ground in bumping work using the boom lowering operation, and is stored in the ROM 110*b* in advance. When the boom cylinder 5 operates in a contracting direction, and the bucket 10 is pressed (struck) against the ground, the pressure of the rod side hydraulic chamber of the boom cylinder 5 rises sharply. It is therefore possible to determine whether or not the bumping operation is being performed, by monitoring the pressure of the rod side hydraulic chamber of the boom cylinder 5.

The trajectory computing section 111 determines that the hydraulic excavator 100 is performing the bumping operation, when the boom lowering operation amount of the right control lever device 22*a* is equal to or more than the operation amount threshold value Lb1 and the pressure Pbr of the rod side hydraulic chamber of the boom cylinder 5 is equal to or more than the pressure threshold value Pbr0. The trajectory computing section 111 determines that the hydraulic excavator 100 is not performing the bumping operation, when the boom lowering operation amount of the right control lever device 22*a* is less than the operation amount threshold value Lb1 or when the pressure Pbr of the rod side hydraulic chamber of the boom cylinder 5 is less than the pressure threshold value Pbr0.

It is to be noted that determining methods for the excavating operation, the compacting operation, and the bumping operation are not limited to the above-described methods. An operation may be determined on the basis of only one of the operation information from the operation sensor 163 and the pressure information from the pressure sensor 162. For example, it may be determined that the bumping operation is being performed, when a temporal change rate of the pressure Pbr of the rod side hydraulic chamber of the boom cylinder 5 is equal to or more than a threshold value, and it may be determined that the bumping operation is not being performed, when the temporal change rate of the pressure Pbr of the rod side hydraulic chamber of the boom cylinder 5 is less than the threshold value.

When the trajectory computing section 111 determines that one of the excavating operation, the compacting operation, and the bumping operation is being performed, the trajectory computing section 111 performs trajectory computation processing. In the following, the trajectory computation processing will be described in detail.

The trajectory computing section 111 generates trajectory information (trajectory data) constituted by the position coordinates of monitor points set to the bucket 10 at each time, by repeatedly computing the position coordinates of the monitor points in predetermined computation cycles.

The monitor points are points for identifying the trajectory of a part at which the bucket 10 is in contact with the ground when the work device 100*a* is performing work. The monitor points are set according to the operation content (work content) of the hydraulic excavator 100. When the trajectory computing section 111 determines that the excavating operation is being performed, the trajectory computing section 111 sets two points at a left end and a right end of the claw tip Pb of the bucket 10 as the monitor points. When the trajectory computing section 111 determines that the compacting operation is being performed, the trajectory computing section 111 sets two points at a left end and a right end of the specific part on the back surface of the bucket 10 as the monitor points. When the trajectory computing section 111 determines that the bumping operation is being performed, the trajectory computing section 111 sets points at four corners of the bottom surface of the bucket 10 as the monitor points.

The trajectory computing section 111 computes the position coordinates of the monitor points in the site coordinate system at each predetermined time (computation cycle) on the basis of the posture information output by the posture sensor 130 (the boom angle α, the arm angle β, and the bucket angle γ, antenna position coordinates in the site coordinate system of the first GNSS antenna 35*a*, and the azimuth angle θy, the roll angle θr, and the pitch angle θp of the machine body 100*b* (swing structure 12)) and the dimensional information of each part of the hydraulic excavator 100 stored in the storage device 169. The position coordinates of the monitor points computed at each predetermined time are information representing the trajectory of the bucket 10. That is, the trajectory computing section 111 computes the trajectory of the bucket 10 on the basis of the posture information and the dimensional information of the hydraulic excavator 100.

Referring to FIG. 6, description will be made of an example of a specific method of computing the position coordinates of the monitor points when the excavating operation is being performed. FIG. 6 is a diagram illustrating the excavator reference coordinate system. The excavator reference coordinate system of FIG. 6 is a coordinate system set to the swing structure 12. In the excavator reference coordinate system, a center of a left-right width of the boom pin 91 on a central axis of the boom pin 91 is set as an origin O. In addition, in the excavator reference coordinate system, an axis that is parallel with a swing central axis of the swing structure 12 and extends upward of the swing structure 12 from the origin O is set as a Z-axis, and an axis that is orthogonal to the Z-axis and extends forwardly of the swing structure 12 from the origin O is set as an X-axis. In addition, in the excavator reference coordinate system, an axis that is orthogonal to the Z-axis and the X-axis and extends in the left direction of the swing structure 12 from the origin O is set as a Y-axis. That is, the central axis of the boom pin 91 extending in the left-right direction of the swing structure 12 is set as the Y-axis.

The angle of inclination of the boom 8 with respect to an X-Y plane is the boom angle α. The angle of inclination of the arm 9 with respect to the boom 8 is the arm angle β. The angle of inclination of the bucket 10 with respect to the arm 9 is the bucket angle γ. The boom angle α is a value that becomes a minimum in a state in which the boom 8 is raised to an upper limit (the boom cylinder 5 is in a most extended state), and becomes a maximum in a state in which the boom 8 is lowered to a lower limit (the boom cylinder 5 is in a most contracted state). The arm angle β is a value that becomes a minimum when the arm cylinder 6 is in a most contracted state, and becomes a maximum when the arm cylinder 6 is in a most extended state. The bucket angle γ is a value that becomes a minimum when the bucket cylinder 7 is in a most contracted state (state of FIG. 6), and becomes a maximum when the bucket cylinder 7 is in a most extended state. In addition, the angle of inclination of the machine body 100*b* (swing structure 12) about the Y-axis is the pitch angle θp, the angle of inclination of the machine body 100*b* (swing structure 12) about the X axis is the roll angle θr, and the angle of inclination of the machine body 100*b* (swing structure 12) about the Z axis is the azimuth angle θy.

A machine body coordinate system and the site coordinate system can mutually be transformed by using the azimuth angle θy, the pitch angle θp, and the roll angle θr, the coordinate value of the first GNSS antenna 35*a* in the excavator reference coordinate system, and the coordinate value of the first GNSS antenna 35*a* in the site coordinate system which coordinate value is obtained by RTK-GNSS positioning.

The position coordinates of the monitor points in the site coordinate system are obtained by transforming the rotational angles α, β, and γ of the boom 8, the arm 9, and the bucket 10 and position coordinates in the excavator reference coordinate system computed from the dimensional information of the work device 100*a*.

The Z-coordinate and X-coordinate of a monitor point (claw tip of the bucket 10 in the example illustrated in FIG. 6) Pb in the excavator reference coordinate system can be expressed by the following Equations (1) and (2).

[Math. 1]

$$Z=L_{bm}\cdot\sin\alpha+L_{am}\cdot\sin(\alpha+\beta)+L_{bkt}\cdot\sin(\alpha+\beta+\gamma) \quad (1)$$

[Math. 2]

$$X=L_{bm}\cdot\cos\alpha+L_{am}\cdot\cos(\alpha+\beta)+L_{bkt}\cdot\cos(\alpha+\beta+\gamma) \quad (2)$$

Incidentally, the Y-coordinate of the claw tip Pb of the bucket 10 as a monitor point can be obtained from an amount of offset (fixed value) Yo in a Y-axis direction from the origin O to the center in the width direction of the bucket 10 and the width of the claw tip of the bucket 10. For example, when the width of the claw tip Pb of the bucket 10 is bw, the Y-coordinate of the monitor point is Yo−(bw/2) and Yo+(bw/2). The amount of offset Yo is stored in the storage device 169 in advance. Incidentally, when the Y-coordinate of the center in the width direction of the bucket 10 is 0 (zero), the Y-coordinate of the monitor point is (−bw/2) and (+bw/2).

Supposing that a vector from the first GNSS antenna 35*a* to the origin of the excavator reference coordinate system in the excavator reference coordinate system is (offset_X, offset_Y, offset_Z), that rotation matrices effecting rotation about the X-, Y-, and Z-axes in the excavator reference coordinate system are Rx(θr), Ry(θp), and Rz(θy), that the position coordinates of the monitor point in the excavator reference coordinate system are (X, Y, Z), and that a vector from the origin of the site coordinate system to the position coordinates of the first GNSS antenna 35*a* is (offset_E, offset_N, offset_H), position coordinates (E, N, H) of the monitor point in the site coordinate system are computed by the following Equation (3).

[Math. 3]

$$\begin{pmatrix} E \\ N \\ H \end{pmatrix} = Rx(\theta_r)\cdot Ry(\theta_p)\cdot Rz(\theta_y)\left(\begin{pmatrix} \text{offset_X} \\ \text{offset_Y} \\ \text{offset_Z} \end{pmatrix} + \begin{pmatrix} X \\ Y \\ Z \end{pmatrix}\right) + \begin{pmatrix} \text{offset_E} \\ \text{offset_N} \\ \text{offset_H} \end{pmatrix} \quad (3)$$

The complementary information computing section 112 illustrated in FIG. 5 computes complementary information on the basis of the trajectory (position coordinates of monitor points) of the bucket 10 of the work device 100*a* which trajectory is computed by the trajectory computing section 111 and the target surface set by the target surface setting device 161. The complementary information is information complementing the terrain profile data to be described later and is information about a plane constituting the trajectory of the bucket 10. In the present embodiment, the complementary information computing section 112 computes, as the complementary information, a vector normal to the plane constituting the trajectory that the bucket 10 has passed through.

Figure 7:
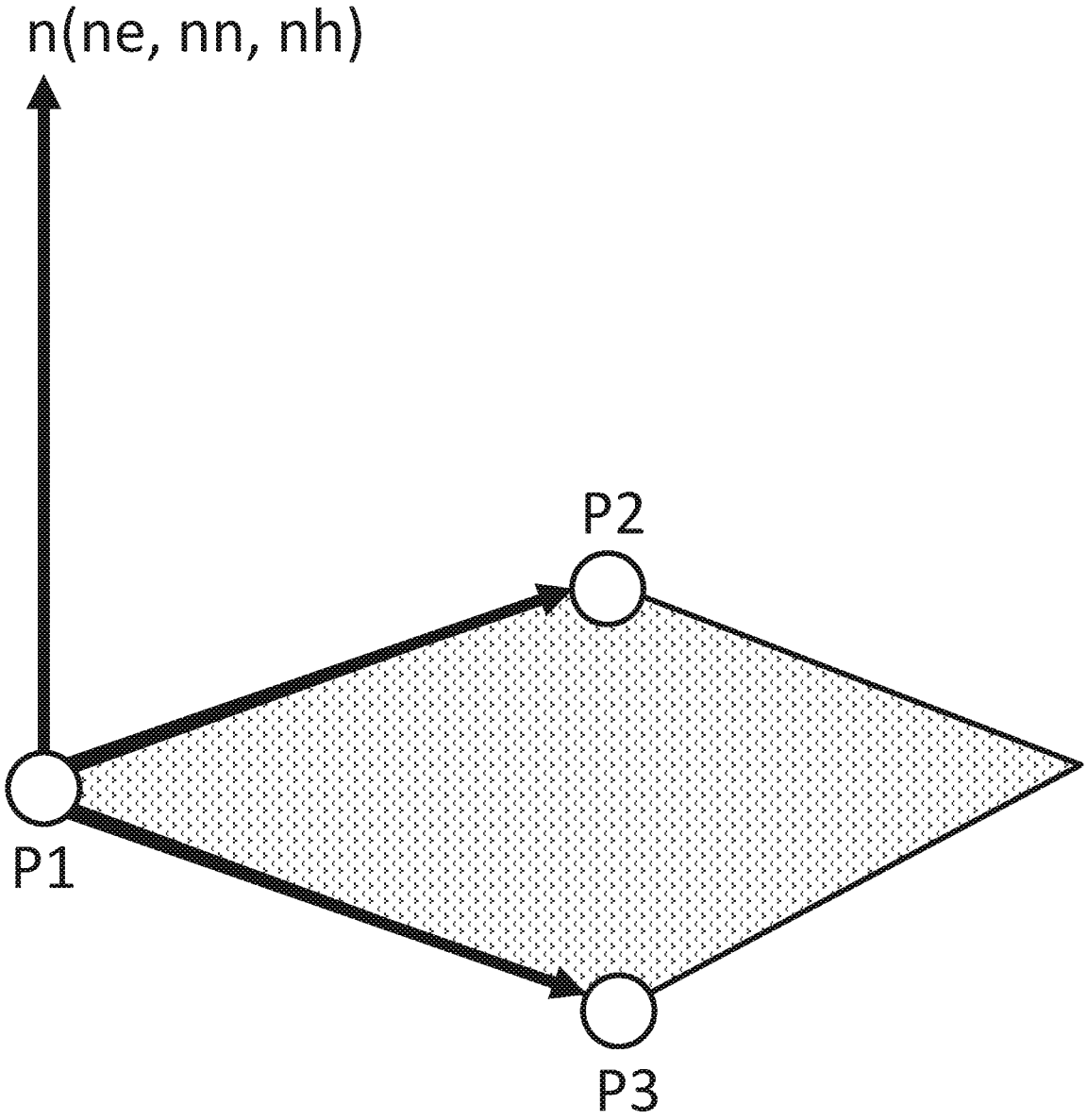
FIG. 7 is a diagram illustrating a normal vector of a plane constituting a trajectory through which a bucket has passed.

FIG. 7 is a diagram illustrating a normal vector n of a plane constituting the trajectory of the bucket 10. As illustrated in FIG. 7, the complementary information computing section 112 selects three points, that is, a point P1, a point P2, and a point P3, from among points on the plane constituting the trajectory of the bucket 10. The complementary information computing section 112 computes the normal vector n (ne, nn, nh) perpendicular to the plane including the point P1, the point P2, and the point P3 from an outer product of a vector P1P2 and a vector P1P3. The vector P1P2 is a vector connecting the point P1 and the point P2 to each other. The vector P1P3 is a vector connecting the point P1 and the point P3 to each other. It suffices for the point P1, the point P2, and the point P3 to be freely-selected three different points present on the plane constituting the trajectory of the bucket 10. Incidentally, ne is a component in an E-axis direction of the normal vector n, nn is a component in an N-axis direction of the normal vector n, and nh is a component in an H-axis direction of the normal vector n.

When the hydraulic excavator 100 is performing the excavating operation, the complementary information computing section 112 sets the left and right ends of the claw tip of the bucket 10 at a certain moment (the bucket 10 before movement) as the point P1 and the point P2, and sets one of the left and right ends of the claw tip of the bucket 10 after the passage of a predetermined time (the bucket 10 after the movement) as the point P3. When the hydraulic excavator 100 is performing the compacting operation, the complementary information computing section 112 sets the left and right ends of the specific part on the back surface of the bucket 10 at a certain moment (the bucket 10 before movement) as the point P1 and the point P2, and sets one of the left and right ends of the specific part on the back surface of the bucket 10 after the passage of a predetermined time (the bucket 10 after the movement) as the point P3. When the hydraulic excavator 100 is performing the bumping operation, the complementary information computing section 112 sets, as the points P1 to P3, freely-selected three points among the four points at the four corners of the bottom surface of the bucket 10 at a moment at which the bucket 10 is struck against the ground.

When the hydraulic excavator 100 is performing the excavating operation, the complementary information computing section 112 computes the normal vector n as information about the plane constituting the trajectory of the bucket 10, on the basis of the position coordinates of freely-selected points on the work device 100*a* moved by the excavating operation (two points at the left and right ends of the claw tip Pb of the bucket 10). When the hydraulic excavator 100 is performing the compacting operation, the complementary information computing section 112 computes the normal vector n as information about the plane constituting the trajectory of the bucket 10, on the basis of the position coordinates of freely-selected points on the work device 100*a* moved by the compacting operation (two points at the left and right ends of the specific part on the back surface of the bucket 10). When the hydraulic excavator 100 is performing the bumping operation, the complementary information computing section 112 computes the normal vector n as information about the plane constituting the trajectory of the bucket 10, on the basis of the position coordinates of freely-selected points on the surface of the work device 100*a* which surface presses the ground (four points at the four corners of the bottom surface of the bucket 10).

Figure 8:
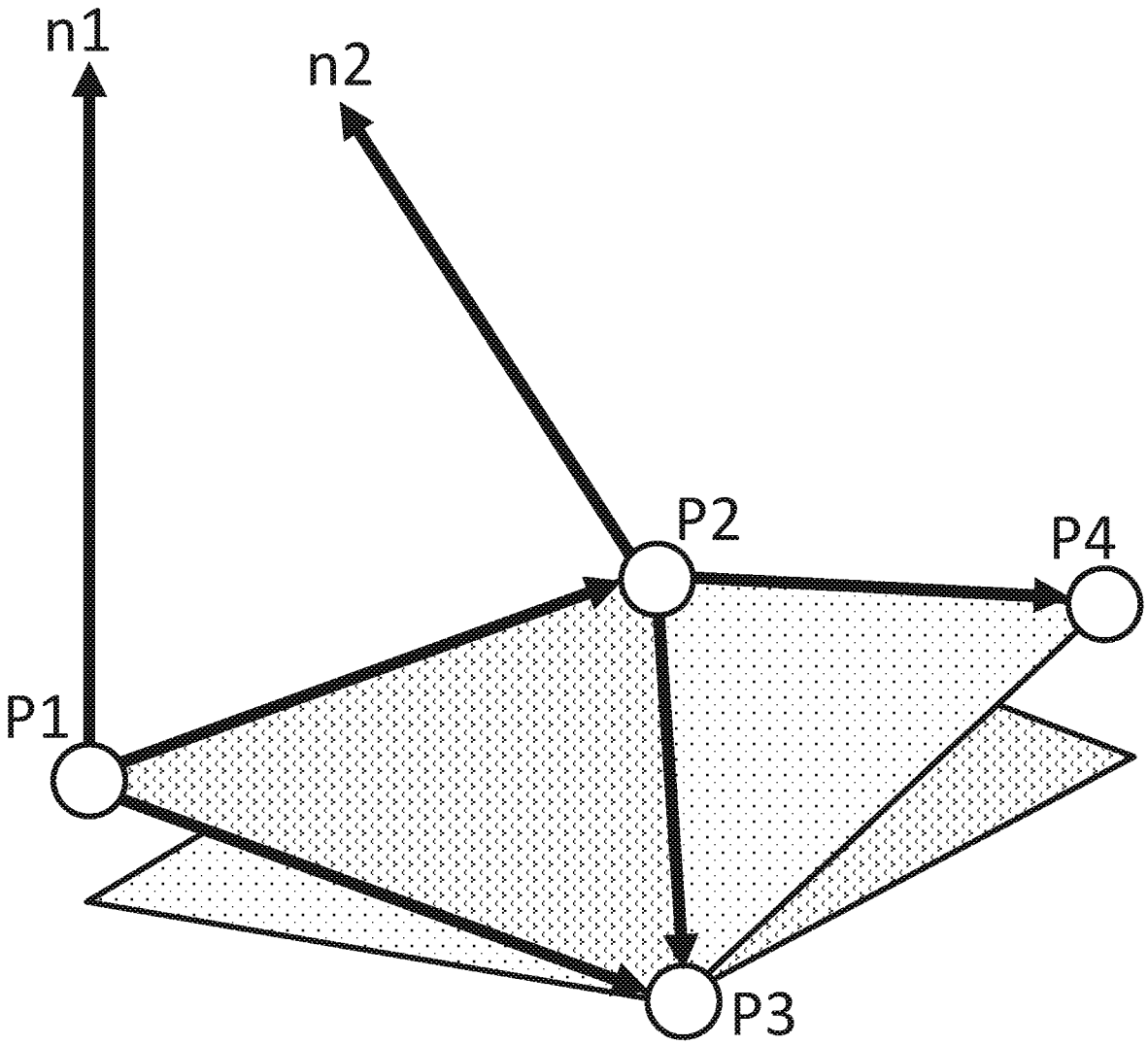
FIG. 8 is a diagram illustrating a normal vector on a curved surface constituting a trajectory through which the bucket has passed.

FIG. 8 is a diagram illustrating normal vectors n1 and n2 on a curved surface constituting the trajectory of the bucket 10. As illustrated in FIG. 8, when the trajectory that the bucket 10 has passed through forms a curved surface, the normal vector may differ according to a method of selecting points. For example, the normal vector n1 obtained when the point P1, the point P2, and the point P3 are selected and the normal vector n2 obtained when the point P2, the point P3, and a point P4 are selected are different from each other. Incidentally, in the present embodiment, when the excavating operation is being performed, the point P1 and the point P2 are the two points at the left and right ends of the claw tip Pb of the bucket 10 before movement, and the point P3 and the point P4 are the two points at the left and right ends of the claw tip Pb of the bucket 10 after the movement. When the compacting operation is being performed, the point P1 and the point P2 are the two points at the left and right ends of the specific part on the back surface of the bucket 10 before movement, and the point P3 and the point P4 are the two points at the left and right ends of the specific part on the back surface of the bucket 10 after the movement. When the bumping operation is being performed, the points P1 to P4 are the four points at the four corners of the bottom surface of the bucket 10.

In the present embodiment, the complementary information computing section 112 computes distances (written also as target surface interval distances) in a vertical direction (H-axis direction) between the target surface St set by the target surface setting device 161 and monitor points (points P1 to P4). When not all of the points P1 to P4 as the left and right ends of the claw tip Pb of the bucket 10 before and after movement are on a same plane, the complementary information computing section 112 selects three points having shorter target surface interval distances and computes the normal vector n on the basis of the three points.

The construction history generating section 113 illustrated in FIG. 5 generates construction history data on the basis of the trajectory (position coordinates of the monitor points) of the bucket 10 of the work device 100*a* which trajectory is computed by the trajectory computing section 111, the complementary information (normal vector) computed by the complementary information computing section 112, and the target surface set by the target surface setting device 161. The construction history generating section 113 stores the generated construction history data in the storage device 169.

FIG. 9 is a diagram illustrating an example of the construction history data. As illustrated in FIG. 9, the construction history data is an aggregate of log data recorded together with times (time stamps) at intervals of a predetermined time (1 [sec] in the example illustrated in FIG. 9). The log data of the construction history data includes the position coordinates of a trajectory constituent point (position coordinates of the trajectory) obtained by converting the trajectory of the bucket 10 into grids, the complementary information (normal vector) computed by the complementary information computing section 112, a result of operation determination made by the trajectory computing section 111, and a distance (target surface interval distance) from a monitor point (claw tip of the bucket 10) to the target surface St which distance is computed by the complementary information computing section 112.

The construction history generating section 113 generates the construction history data by recording the positional information of the trajectory of the bucket 10 (position coordinates of the monitor point) and the complementary information (normal vector n) or the like for each grid. That is, in the construction history data, the positional information of the trajectory of the bucket 10 and the information about the plane constituting the trajectory of the bucket 10 are stored in association with each other. The construction history generating section 113 computes the position coordinates of a trajectory constituent point as follows.

Figure 10:
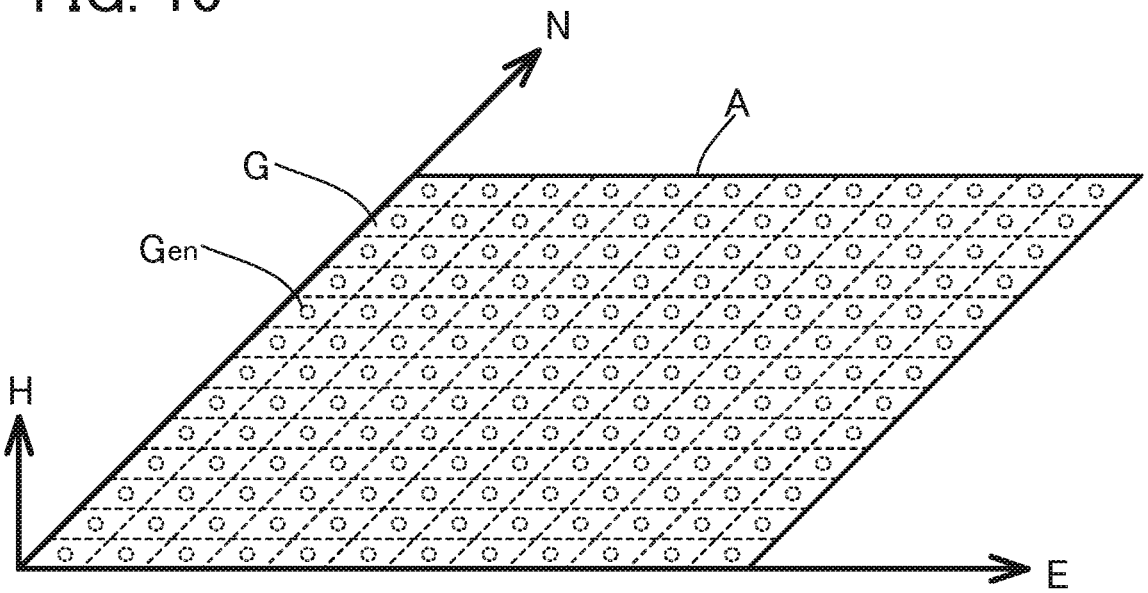
FIG. 10 is a diagram illustrating a work area A resulting from grid processing.

A method of computing the position coordinates of a trajectory constituent point will be described with reference to FIGS. 10 to 12. FIG. 10 is a diagram illustrating a work area A resulting from grid processing. As illustrated in FIG. 10, the construction history generating section 113 performs the grid processing that divides, in a lattice manner, the predetermined area (work area) A in an EN plane parallel with the E-axis and the N-axis of the site coordinate system (EN plane orthogonal to the H-axis). As a result of the grid processing, grids G at fixed intervals are set which are uniquely set to the site coordinate system.

Figure 11:
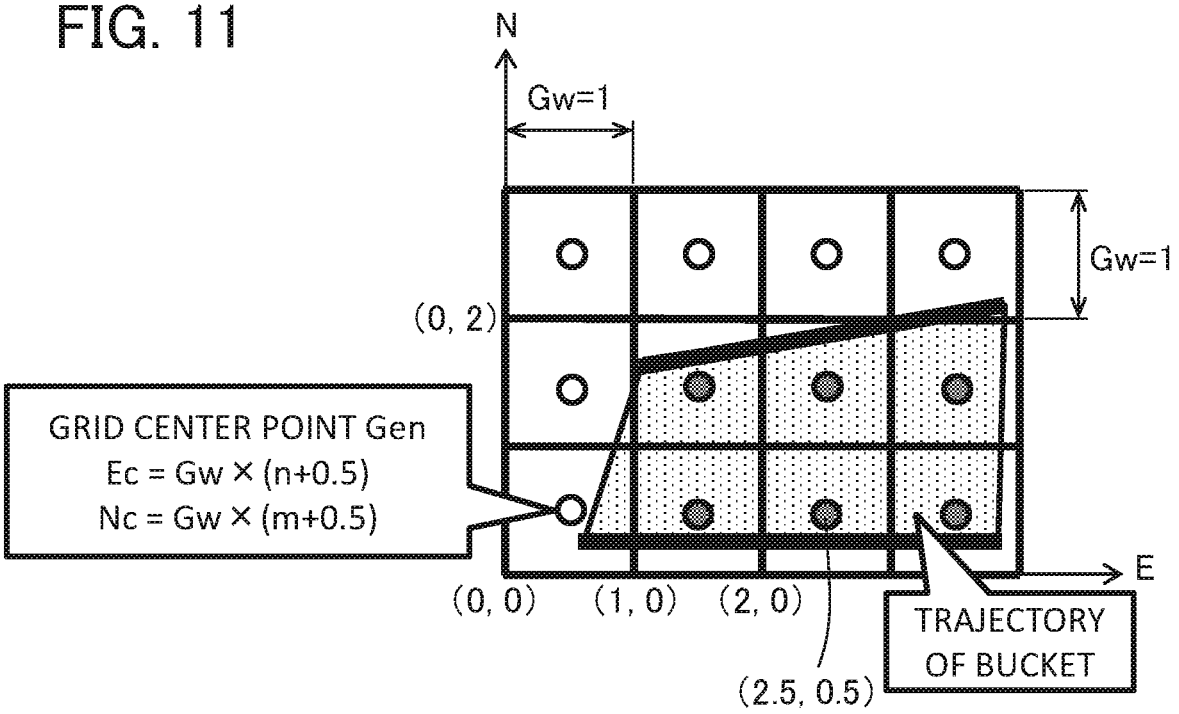
FIG. 11 is a diagram illustrating a grid width Gw and a grid center point Gen.

FIG. 11 is a diagram illustrating a grid width Gw and a grid center point Gen. As illustrated in FIG. 11, in the present embodiment, a width (grid width Gw) in the E-axis direction and a width (grid width Gw) in the N-axis direction of a grid G are the same. In the example illustrated in FIG. 11, the grid width Gw is set at 1 m. Incidentally, as the grid width Gw, a freely-selected value is set in consideration of the data volume of the construction history data, the density of a point group constituting the terrain profile data to be described later, and the like. The position coordinates (Ec, Nc) of a center point Gen of the grid G on the EN plane are $Ec=Gw\times(n+0.5)$ and $Nc=Gw\times(m+0.5)$. Here, n and m are integers set with the position coordinates (0, 0) of the origin of the EN plane as a reference, and correspond to the position coordinates of a left corner of the grid G in FIG. 11. For example, the position coordinates (Ec, Nc) of the center point Gen of a grid G having position coordinates (2, 0) illustrated in FIG. 11 as the position coordinates of a left corner thereof are $Ec=1\times(2+0.5)=2.5$ and $Nc=1\times(0+0.5)=0.5$.

In FIG. 11, the trajectory of the bucket 10 is indicated in a manner being projected onto the EN plane. The construction history generating section 113 determines whether or not there is a grid center point Gen within the trajectory of the bucket 10 which trajectory is projected in a predetermined time width (for example, a period of one second).

Figure 12:
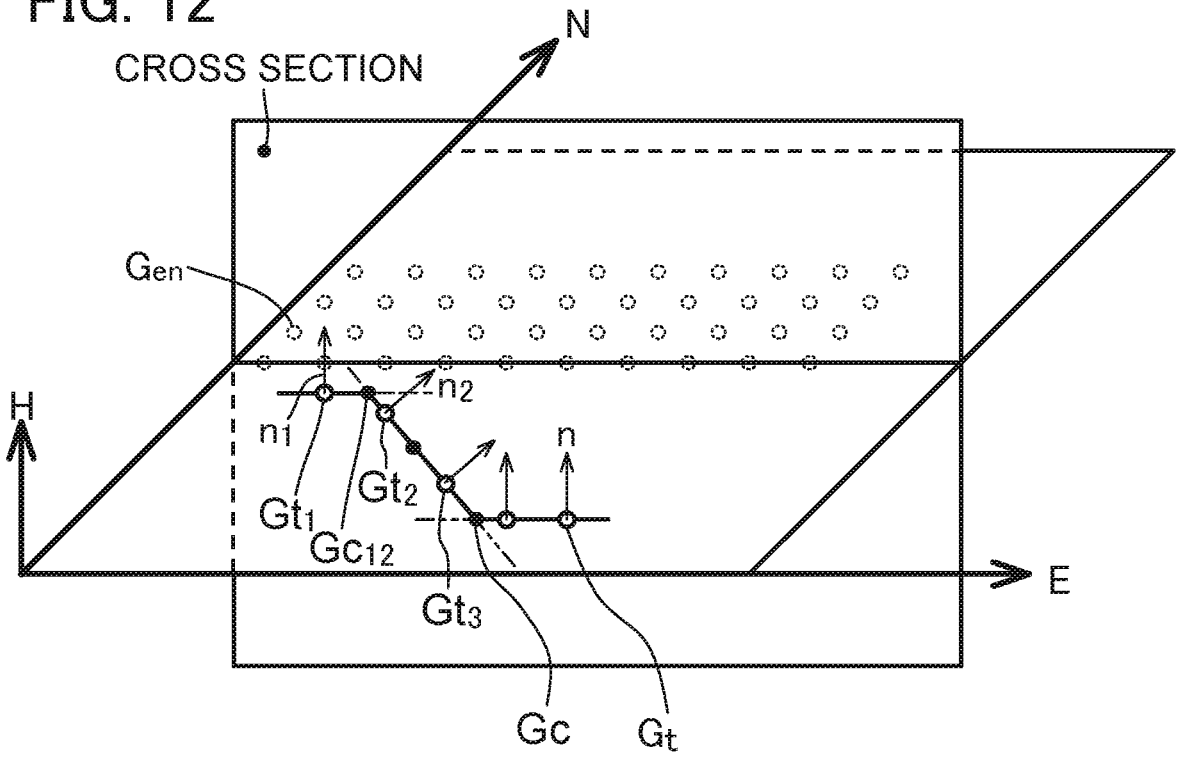
FIG. 12 is a diagram illustrating conversion of the trajectory of the bucket into grids.

FIG. 12 is a diagram illustrating conversion of the trajectory of the bucket 10 into grids. As illustrated in FIG. 12, when the construction history generating section 113 determines that there is a grid center point within the projected trajectory of the bucket 10, the construction history generating section 113 sets, as a trajectory constituent point Gt, a point of intersection of an axis (hereinafter written also as a grid central axis) that passes through the grid center point Gen on the EN plane and is parallel with the H-axis and a plane constituting the trajectory of the bucket 10 obtained from the position coordinates of monitor points, and computes the position coordinates of the trajectory constituent point Gt. The position coordinates of the trajectory constituent point Gt are the trajectory information of the bucket 10, the trajectory information constituting the construction history data, and are recorded according to the format of a log file of the construction history data, as illustrated in FIG. 9.

Incidentally, when the grid width Gw is small and the position coordinates of a plurality of trajectory constituent points Gt need to be recorded in the log data of a same time stamp, the number of grids at the same time stamp may be recorded, and one piece of log data (log data at the same time) may be set as variable-length data, as illustrated in FIG. 13. This enables a reduction in the data volume of the construction history data.

The transmitting section 114 illustrated in FIG. 5 transmits the log data of the construction history data generated by the construction history generating section 113 and stored in the storage device 169 to the management controller 150.

Construction history data generation processing performed by the machine controller 110 will be described with reference to FIG. 14. The processing of a flowchart illustrated in FIG. 14 is, for example, started by turning on an ignition switch (not illustrated), and repeatedly performed in predetermined computation cycles after an initial setting not illustrated is made.

Figure 14:
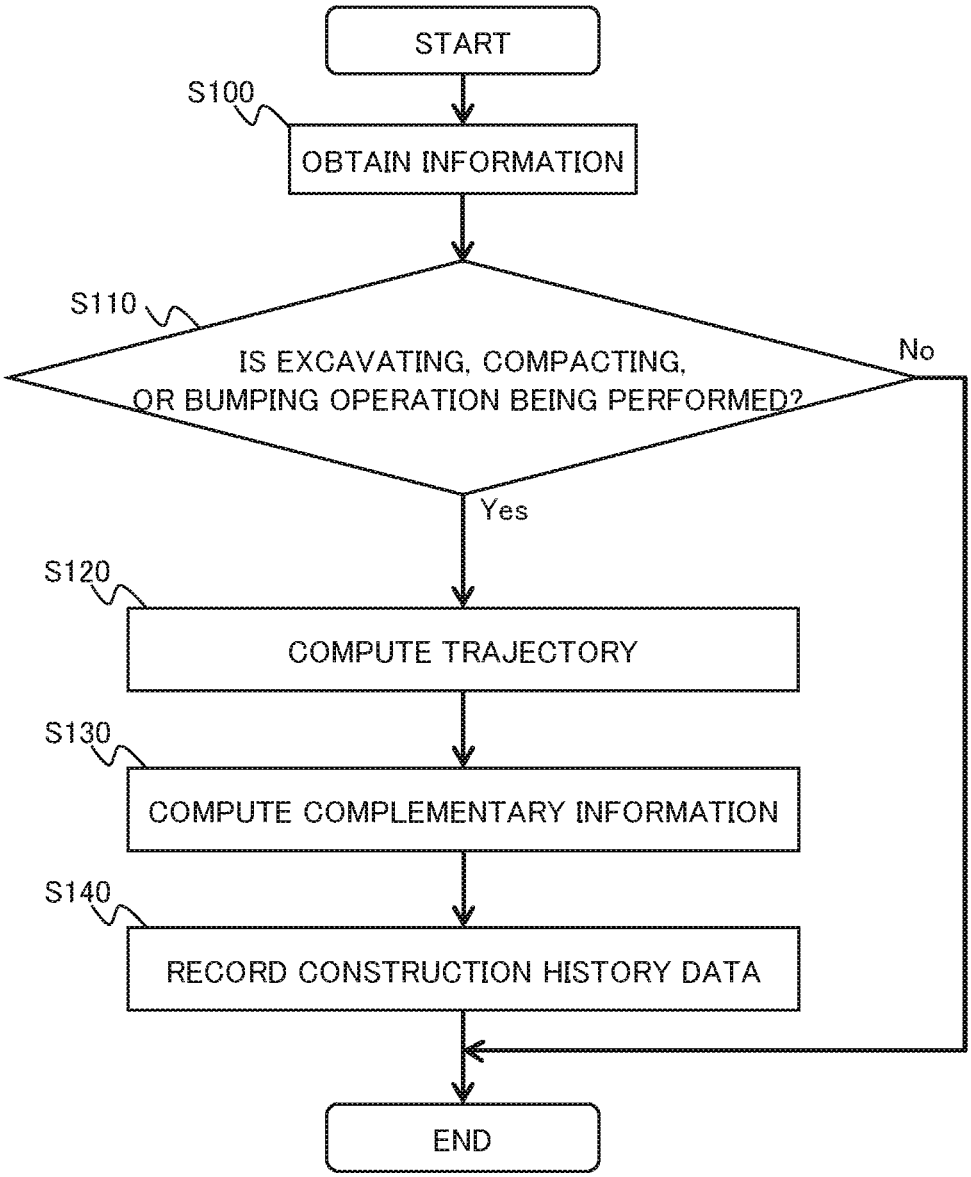
FIG. 14 is a flowchart illustrating construction history data generation processing performed by the machine controller.

As illustrated in FIG. 14, in step S100, the machine controller 110 obtains the operation information (operation directions and operation amounts) sensed by the operation sensor 163, the posture information (the position coordinates of the hydraulic excavator 100, the boom angle $\alpha$, the arm angle $\beta$, the bucket angle $\gamma$, the pitch angle $\theta p$, the roll angle $\theta r$, and the azimuth angle $\theta y$) sensed by the posture sensor 130, the pressure information sensed by the pressure sensor 162, and the like. The machine controller 110 then proceeds to step S110.

In step S110, the machine controller 110 performs operation determination processing that determines whether or not one of the excavating operation, the compacting operation, and the bumping operation is being performed, on the basis of the operation information and the pressure information obtained in step S100. When it is determined in step S110 that one of the excavating operation, the compacting operation, and the bumping operation is being performed, the processing proceeds to step S120. When it is determined in step S110 that none of the excavating operation, the compacting operation, and the bumping operation is being performed, the processing indicated in the flowchart of FIG. 14 in the present computation cycle is ended, and the processing proceeds to step S100 in a next computation cycle.

In step S120, the machine controller 110 computes the trajectory of the bucket 10 (position coordinates of monitor points) and then proceeds to step S130. In step S130, the machine controller 110 computes a normal vector n as complementary information on the basis of the position coordinates of monitor points computed in step S120 in an immediately preceding computation cycle (for example, the position coordinates of the points P1 and P2 illustrated in FIG. 7) and the position coordinates of the monitor points computed in step S120 in the present computation cycle (for example, the position coordinates of the point P3 illustrated in FIG. 7), and then proceeds to step S140.

In step S140, the machine controller 110 generates the log data of construction history data on the basis of the trajectory information and the complementary information computed in step S120 and step S130 and records the log data of the construction history data in the storage device 169. The machine controller 110 then ends the processing indicated in the flowchart of FIG. 14. Incidentally, the processing of steps S100 to S130 is performed in a predetermined computation cycle t1 (for example, 10 [msec]), whereas the processing of recording the construction history data (S140) is performed at intervals of a predetermined time t2 (for example, at intervals of 1 [sec]) (t2>t1). In a computation cycle in which the processing of recording the construction history data (S140) is not performed, the processing proceeds to step S100 in a next computation cycle after completing step S130.

The log data of the construction history data is accumulated in the storage device 169 by repeatedly performing the processing indicated in the flowchart of FIG. 14. The log data of the construction history data accumulated in the storage device 169 is transmitted to the management server 51 in a predetermined transmission cycle.

As illustrated in FIG. 5, the management controller (second processing apparatus) 150 of the management server 51 receives the construction history data transmitted from the machine controller 110 of the hydraulic excavator 100 and performs processing of generating terrain profile data on the basis of the positional information of the trajectory of the bucket 10 (position coordinates of trajectory constituent points) and information about planes constituting the trajectory of the bucket 10 (normal vectors n as complementary information), the positional information and the plane information being included in the received construction history data. In the following, functions of the management controller 150 will be described in detail.

The management controller 150 functions as a receiving section 151, an extracting section 152, a complementing section 153, and an output section 154. The receiving section 151 receives the construction history data transmitted from the machine controller 110 of the hydraulic excavator 100 and stores the log data of the received construction history data in the storage device 52.

The receiving section 151 accumulates the log data of the construction history data output by the specific hydraulic excavator 100 in the storage device 52. Incidentally, the receiving section 151 may accumulate the construction history data output by a plurality of hydraulic excavators 100 in the storage device 52.

When the log data of the construction history data is accumulated in the storage device 52, the log data may include log data whose construction areas overlap each other. The extracting section 152 estimates and extracts log data in which the trajectory of the bucket 10 is close to a present-condition terrain profile shape in the log data of the construction history data stored in the storage device 52. That is, in a case where the construction history data is data obtained by the excavating operation or the compacting operation, the extracting section 152 extracts log data obtained when the bucket 10 is estimated to have moved along a present-condition terrain profile. In the following, the log data extracted by the extracting section 152 will be written also as the extracted log data.

The extracting section 152 determines for the log data of the construction history data stored in the storage device 52 whether or not construction areas overlap each other (that is, whether or not there are two or more pieces of log data having a same combination of E-coordinates and N-coordinates). The extracting section 152 adopts log data whose construction area is determined not to overlap, that is, log data whose combination of E-coordinates and N-coordinates does not overlap, as the extracted log data as it is. As for log data whose construction areas are determined to overlap each other, that is, log data whose combination of E-coordinates and N-coordinates overlaps that of other log data, the extracting section 152 estimates and extracts log data having a minimum target surface interval distance among these pieces of log data, as log data closest to a present-condition terrain profile shape.

The complementing section 153 performs complementing processing of computing complementary positional information (position coordinates of complementary points Gc) that complements terrain profile information between trajectory constituent points Gt of the log data extracted by the extracting section 152. The complementing section 153 generates terrain profile data (complemented terrain profile data) including the position coordinates of all of the trajectory constituent points Gt included in the extracted log data and the position coordinates of the complementary points Gc. That is, the complementing section 153 generates the terrain profile data on the basis of the extracted log data.

Figure 15:
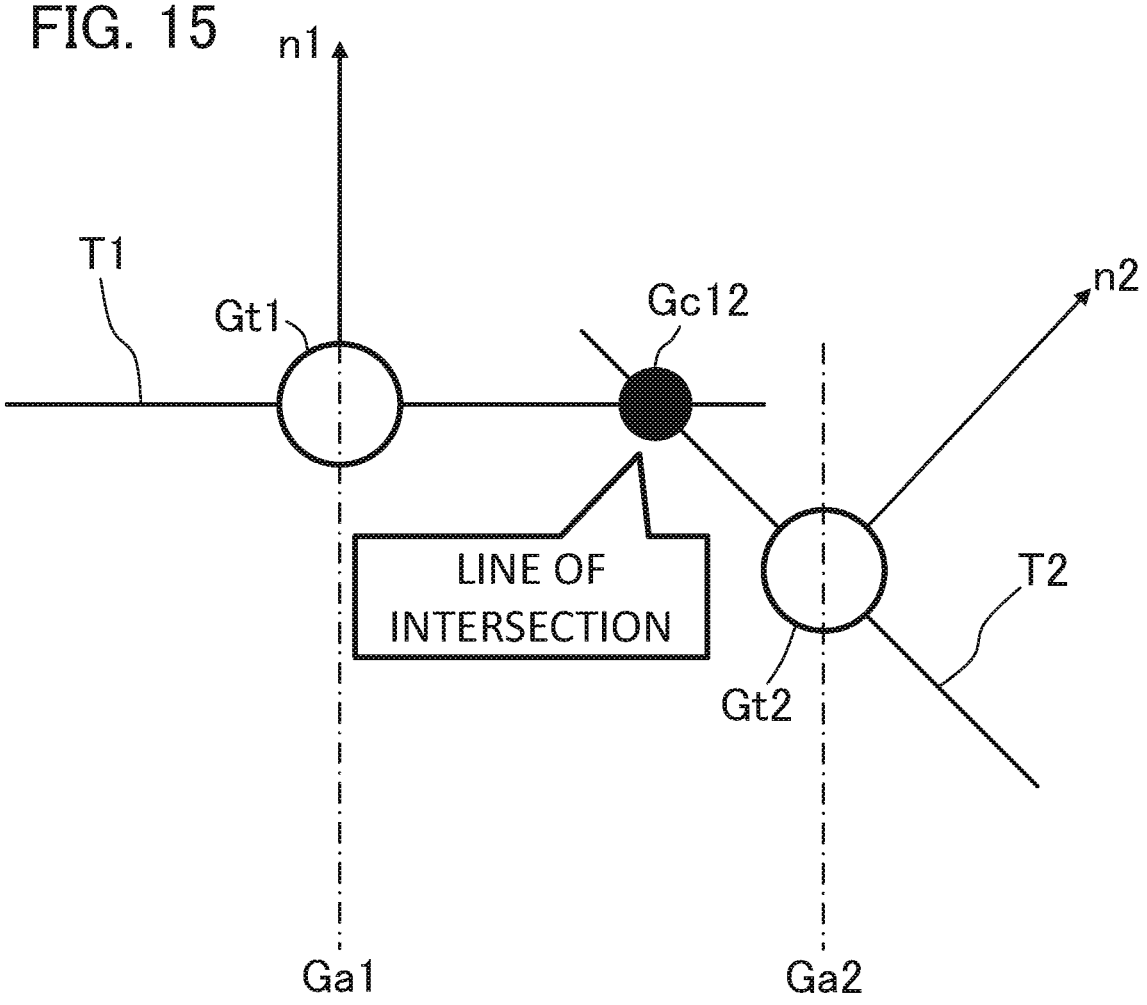
FIG. 15 is a sectional view obtained by a plane that passes through a trajectory constituent point Gt1 on a certain grid central axis and a trajectory constituent point Gt2 on a grid central axis adjacent to the certain grid central axis in an E-axis direction, and which is parallel with an EH plane.

The complementing processing will specifically be described with reference to FIG. 15. FIG. 15 is a sectional view obtained by a plane (hereinafter referred to also as a cross section) that passes through a trajectory constituent point Gt1 on a certain grid central axis Ga1 and a trajectory constituent point Gt2 on a grid central axis Ga2 adjacent to the grid central axis Ga1 in the E-axis direction, and which is parallel with an EH plane. FIG. 15 is a diagram illustrating a part of FIG. 12 on an enlarged scale. Incidentally, in the following, description will be made of a method of computing a complementary point Gc between the trajectory constituent points Gt adjacent to each other in the E-axis direction on the plane (cross section) parallel with the EH plane. However, a similar description applies to a method of computing a complementary point Gc between trajectory constituent points Gt adjacent to each other in the N-axis direction on a plane (cross section) parallel with an NH plane.

The complementing section 153 determines with regard to a certain trajectory constituent point Gt whether or not the extracted log data includes log data related to a trajectory constituent point Gt adjacent in the E-axis direction. When there is no log data related to the adjacent trajectory constituent point Gt, similar processing is performed for a next trajectory constituent point Gt. The following processing is performed when there is log data related to the adjacent trajectory constituent point Gt.

On the basis of the positional information of the trajectory of the bucket 10 (position coordinates of a trajectory constituent point) and information about a plane constituting the trajectory of the bucket 10 (complementary information), the positional information and the plane information being stored for each of a plurality of grids, the complementing section 153 computes a plane tangent to the trajectory in the grid. For example, on the basis of the position coordinates of the trajectory constituent point Gt1 and a normal vector n1 as complementary information, the position coordinates and the normal vector being stored as information of a certain grid G1, the complementing section 153 computes a tangent plane T1 passing through the trajectory constituent point Gt1 and having a normal vector of "n1." In addition, on the basis of the position coordinates of the trajectory constituent point Gt2 and a normal vector n2 as complementary information, the position coordinates and the normal vector being stored as information of a grid G2 adjacent to the grid G1 in the E-axis direction, the complementing section 153 computes a tangent plane T2 passing through the trajectory constituent point Gt2 and having a normal vector of "n2."

The complementing section 153 computes positional information (position coordinates of an intersection point) related to a line of intersection of the planes tangent to the trajectory in the respective grids adjacent to each other, as complementary positional information (position coordinates of a complementary point), between the grids adjacent to each other. The complementing section 153 generates terrain profile data on the basis of the positional information of the trajectory of the bucket 10 (position coordinates of the trajectory constituent points) and the complementary positional information (position coordinates of the complementary point).

Figure 16:
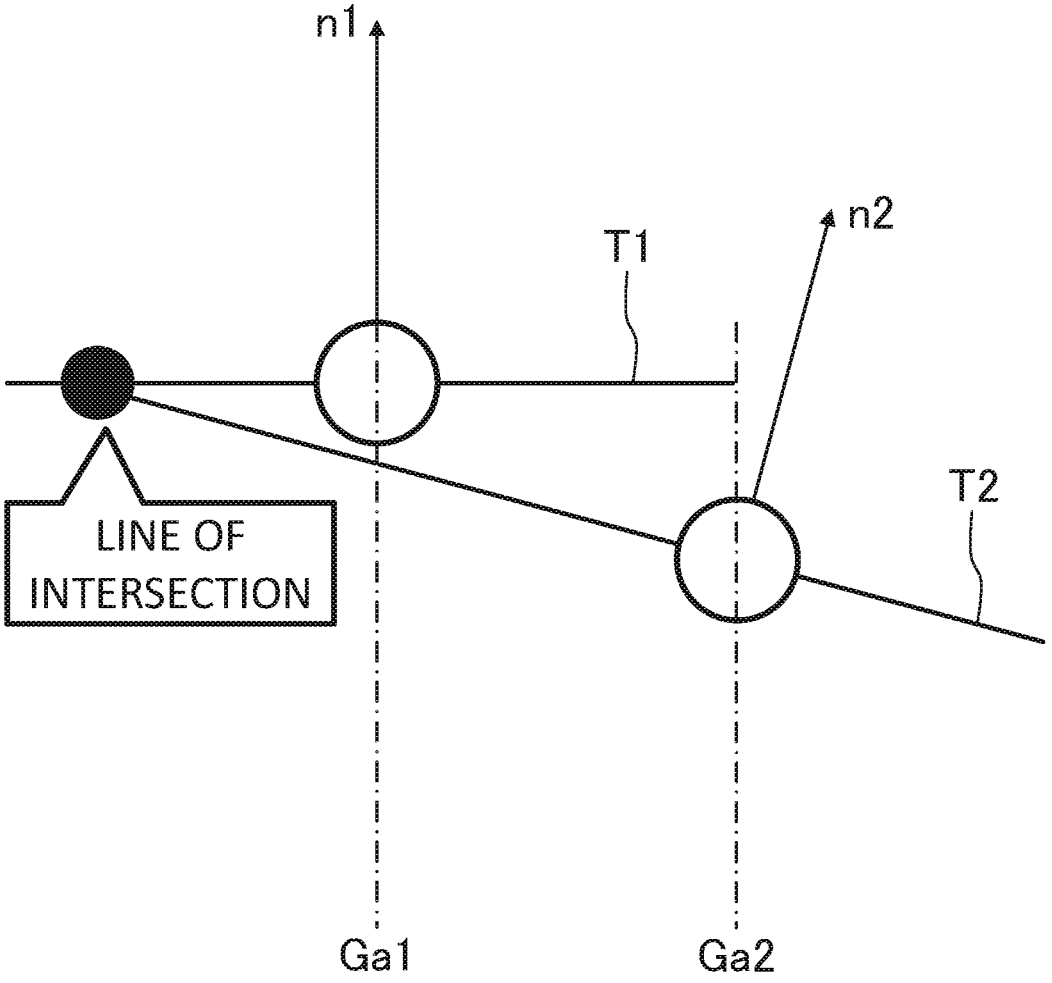
FIG. 16 is a diagram illustrating a case where tangent planes adjacent to each other are close to being parallel with each other.
Figure 17:
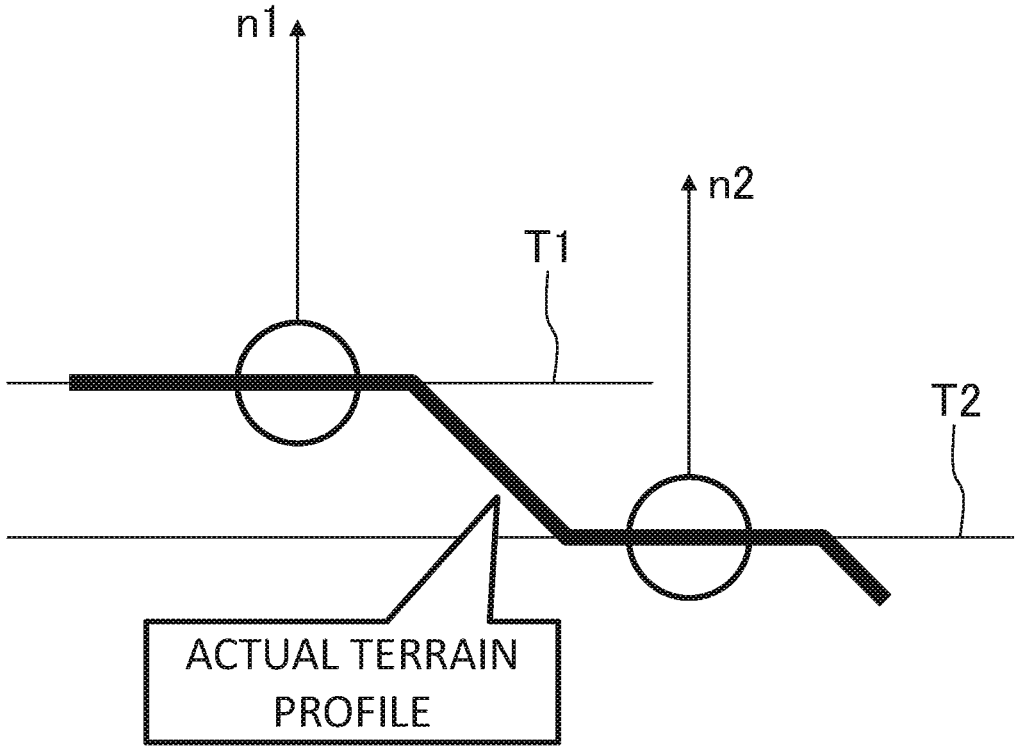
FIG. 17 is a diagram illustrating a case where the grid width Gw is large as compared with the complexity of a terrain profile shape.

For example, the complementing section 153 obtains a line of intersection of the tangent plane T1 and the tangent plane T2, sets a point of intersection of this intersection line and the cross section as a complementary point Gc12, and records the position coordinates of the complementary point Gc12 as complementary positional information in such a manner as to add the complementary positional information to the terrain profile data. Here, when the tangent planes T1 and T2 adjacent to each other are close to being parallel with each other as illustrated in FIG. 16, or when the grid width Gw is large as compared with the complexity of the terrain profile shape as illustrated in FIG. 17, the point Gc12 of intersection of the line of intersection of the two tangent planes T1 and T2 and the cross section may not be present between the two trajectory constituent points Gt1 and Gt2.

The complementing section 153 determines whether or not the point Gc12 of intersection of the line of intersection of the tangent planes T1 and T2 and the cross section is present between the trajectory constituent points Gt1 and Gt2. When the complementing section 153 determines that the intersection point Gc12 is present between the trajectory constituent points Gt1 and Gt2, the complementing section 153 computes the position coordinates of the intersection point Gc12 as complementary positional information (position coordinates of a complementary point) complementing the terrain profile information between the trajectory constituent points Gt1 and Gt2, and ends the complementing processing targeted for the trajectory constituent points Gt1 and Gt2. When the complementing section 153 determines that the intersection point Gc12 is not present between the trajectory constituent points Gt1 and Gt2, the complementing section 153 determines that there is no complementary positional information complementing the terrain profile information between the trajectory constituent points Gt1 and Gt2, and ends the complementing processing targeted for the trajectory constituent points Gt1 and Gt2.

After the complementing section 153 ends the complementing processing targeted for the trajectory constituent points Gt1 and Gt2, the complementing section 153 performs the complementing processing targeted for the next trajectory constituent points Gt2 and Gt3 (see FIG. 12). When the complementing section 153 ends the complementing processing targeted for all of trajectory constituent points adjacent to each other, the complementing section 153 ends the processing of generating the terrain profile data. The terrain profile data thus generated is constituted by the positional information of the trajectory of the bucket 10 (position coordinates of the trajectory constituent points corresponding to the grids) and the complementary positional information (position coordinates of complementary points complementing the terrain profile information between the grids adjacent to each other).

The output section 154 illustrated in FIG. 5 converts the complemented terrain profile data generated by the complementing section 153 into point group data or TIN (Triangulated Irregular Network) data and outputs the data after the conversion as present-condition terrain profile data to a progress management system 190.

The progress management system 190 computes progress management information such as a finished amount and a finished shape on the basis of the present-condition terrain profile data generated by the management controller 150. The progress management system 190 performs information presentation to the manager by outputting the progress management information to the display device 53 and causing the progress management information to be displayed on the display screen of the display device 53. Incidentally, an information presenting method is not limited to this. The progress management system 190 may output the progress management information to a printing device (not illustrated) and cause the progress management information to be printed on a paper medium by the printing device.

In addition, the progress management system 190 may cause the progress management information to be displayed on the display screen of the display device 164 included in the hydraulic excavator 100, the display screen of a portable terminal such as a smart phone, a tablet, or a notebook PC carried by a worker performing work on the periphery of the hydraulic excavator 100, or the like. Incidentally, the management controller 150 may have the functions of the progress management system 190.

Figure 18:
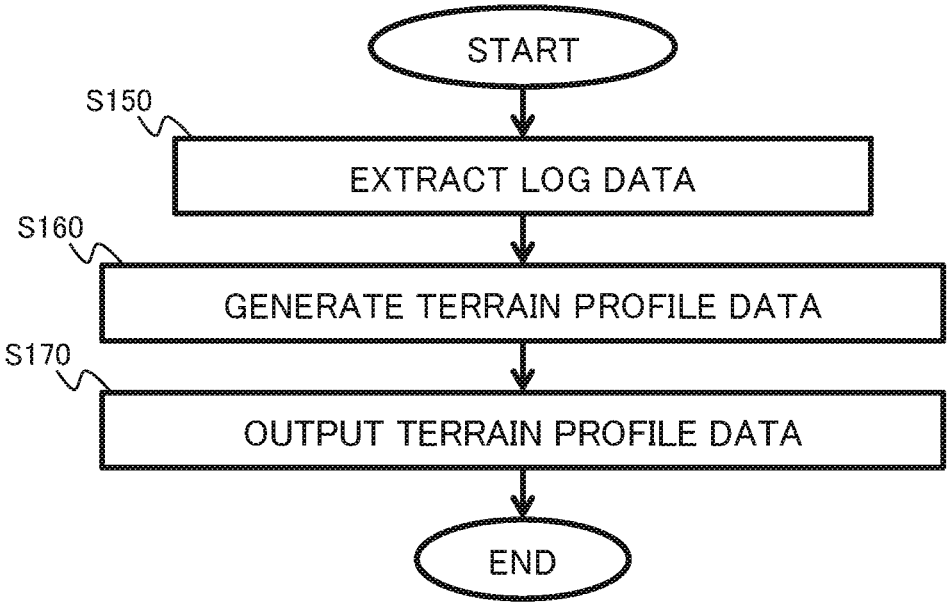
FIG. 18 is a flowchart illustrating terrain profile data generation and output processing performed by the management controller.

Terrain profile data generation and output processing performed by the management controller 150 will be described with reference to FIG. 18. The processing of a flowchart illustrated in FIG. 18 is started by the input device 54 of the management server 51 performing an operation for performing the terrain profile data generation and output processing, and is performed after an initial setting not illustrated is made.

In step S150, the management controller 150 extracts log data closest to the target surface in the log data of the construction history data stored in the storage device 52. The management controller 150 then proceeds to step S160.

In step S160, the management controller 150 performs complementing processing that computes complementary positional information (position coordinates of complementary points) complementing the terrain profile information between the trajectory constituent points, on the basis of the log data extracted in step S150, and generates complemented terrain profile data constituted by the trajectory constituent points and the complementary points. The management controller 150 then proceeds to step S170.

In step S170, the management controller 150 converts the complemented terrain profile data generated in step S160 into point group data or TIN data and outputs the data after the conversion as present-condition terrain profile data to the progress management system 190. The management controller 150 then ends the processing indicated in the flowchart of FIG. 18.

Figure 19A:
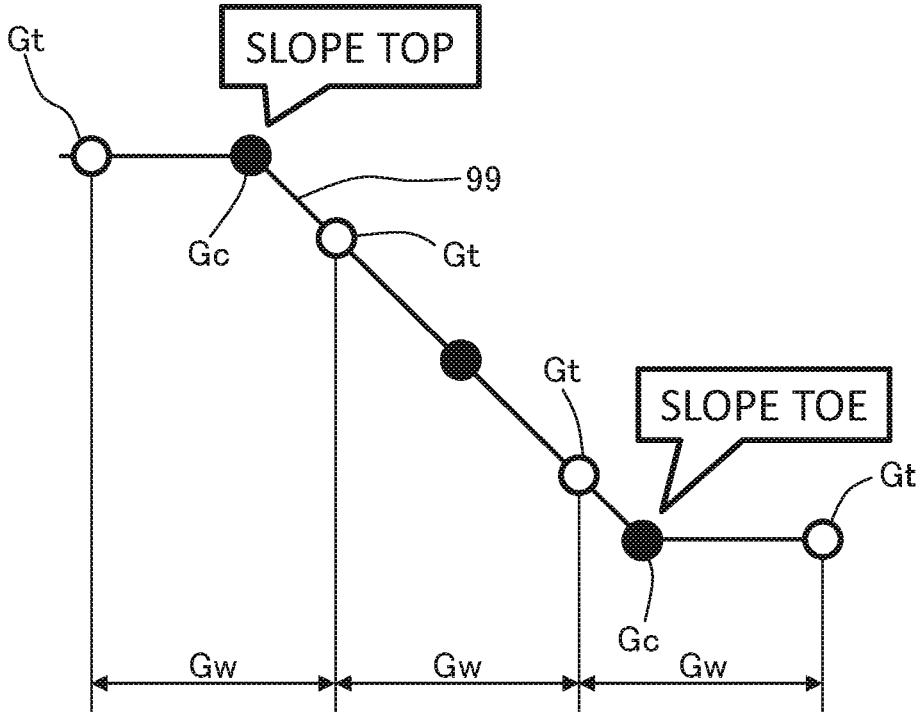
FIG. 19A is a diagram illustrating terrain profile data generated by the management system according to a present embodiment.
Figure 19B:
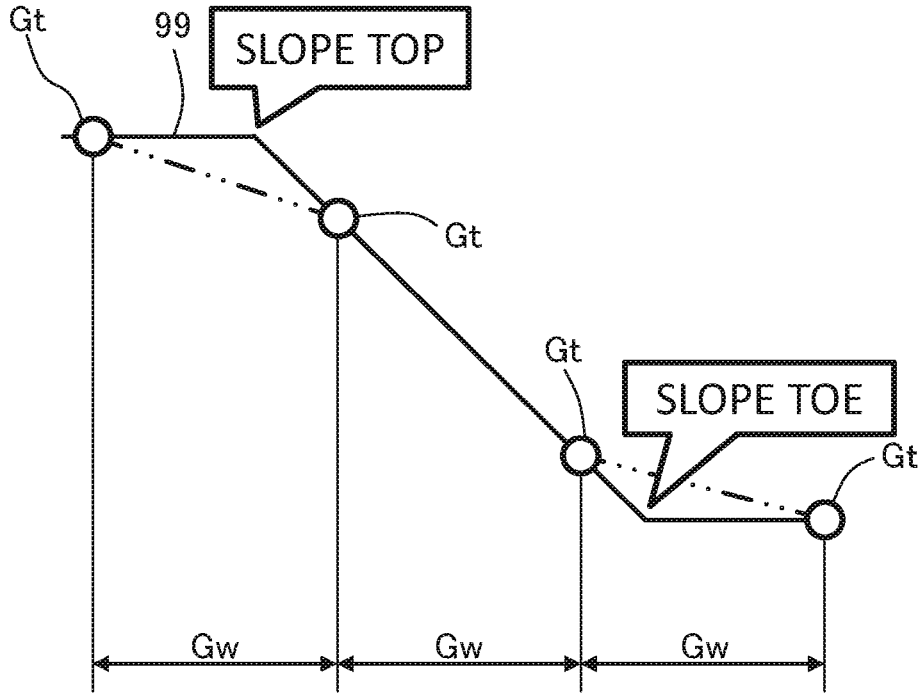
FIG. 19B is a diagram illustrating terrain profile data generated by a management system according to a comparative example of the present embodiment.

Referring to FIG. 19A and FIG. 19B, description will be made of differences between the terrain profile data generated by the management system 1 according to the present embodiment and terrain profile data generated by a management system according to a comparative example of the present embodiment. The management system according to the comparative example of the present embodiment does not include the complementary information in the log data of the construction history data, and generates the terrain profile data from only the trajectory constituent points without performing the complementing processing.

Therefore, as indicated by a chain double-dashed line in FIG. 19B, the management system according to the comparative example of the present embodiment generates the present-condition terrain profile data from only the trajectory constituent points Gt, and hence, may not be able to accurately reproduce a terrain profile shape 99 at characteristic parts such as a slope top and a slope toe. On the other hand, as illustrated in FIG. 19A, the management system 1 according to the present embodiment computes the complementary points Gc between the trajectory constituent points Gt and thus complements the terrain profile information. That is, the present embodiment generates the present-condition terrain profile data from the trajectory constituent points Gt and the complementary points Gc and is thus able to reproduce the terrain profile shape 99 at the characteristic parts such as the slope top and the slope toe accurately.

The foregoing embodiment produces the following actions and effects.

(1) The management system 1 of the hydraulic excavator (work machine) 100 includes the terrain profile data generating system 180 configured to generate terrain profile data representing a finished shape produced by the work device 100*a* of the hydraulic excavator 100, on the basis of a sensing result of the posture sensor 130 that senses the posture of the hydraulic excavator 100. The machine controller 110 of the terrain profile data generating system 180 computes the trajectory of the bucket 10 of the work device 100*a* on the basis of the posture of the hydraulic excavator 100, computes information (complementary information) about a plane constituting the trajectory of the bucket 10 on the basis of the trajectory, and generates construction history data by recording positional information of the trajectory of the bucket 10 (position coordinates of a trajectory constituent point Gt) and the information (complementary information) about the plane constituting the trajectory for each of a plurality of grids obtained by dividing a predetermined area (work area A) in a lattice manner. The management controller 150 of the terrain profile data generating system 180 generates the terrain profile data on the basis of the positional information of the trajectory of the bucket 10 (position coordinates of the trajectory constituent point Gt) and the information (complementary information) about the plane constituting the trajectory, the positional information and the plane information being included in the construction history data.

With this configuration, the management controller 150 of the terrain profile data generating system 180 can generate the terrain profile data by computing complementary positional information (position coordinates of a complementary point Gc) complementing terrain profile information between grids, on the basis of the position coordinates of the trajectory of the bucket 10 and the information (complementary information) about the plane constituting the trajectory of the bucket 10. Therefore, as compared with a case where the terrain profile data is generated from only the positional information (position coordinates of trajectory constituent points) included in the construction history data, it is possible to generate the terrain profile data accurately reproducing the present-condition terrain profile shape including a characteristic terrain profile such as a slope top and a slope toe.

That is, the present embodiment can generate highly accurate terrain profile data without finely setting the grid width. Hence, according to the present embodiment, it is possible to provide the management system 1 of the hydraulic excavator 100 which management system can generate highly accurate terrain profile data, while reducing the amount of the construction history data necessary to generate the terrain profile data.

(2) In the present embodiment, the machine controller 110 of the terrain profile data generating system 180 computes a plane tangent to the trajectory in each grid on the basis of the positional information of the trajectory of the bucket 10 (position coordinates of the trajectory constituent point Gt) and the information (complementary information) about the plane constituting the trajectory, the positional information and the plane information being recorded for each of the plurality of grids, computes positional information (for example, the position coordinates of the intersection point Gc12) related to a line of intersection of the planes (for example, T1 and T2) tangent to the trajectory in respective grids adjacent to each other as complementary positional information (for example, the position coordinates of the complementary point Gc12) between the grids adjacent to each other, and generates the terrain profile data on the basis of the positional information of the trajectory of the bucket 10 (position coordinates of the trajectory constituent point Gt) and the complementary positional information (position coordinates of the complementary point Gc). Hence, it is possible to generate the terrain profile data close to the present-condition terrain profile shape.

(3) The terrain profile data generating system 180 accumulates log data of the construction history data, estimates and extracts log data in which the trajectory of the bucket 10 is close to the present-condition terrain profile shape in the log data of the construction history data, and generates the terrain profile data on the basis of the extracted log data. Hence, it is possible to generate the terrain profile data close to the present-condition terrain profile shape with higher accuracy.

(4) The terrain profile data generating system 180 includes the machine controller (first processing apparatus) 110 that is disposed in the hydraulic excavator 100 and is configured to perform processing of generating the construction history data on the basis of the posture of the hydraulic excavator 100 sensed by the posture sensor 130 and transmitting the generated construction history data to the management server (server) 51 external to the hydraulic excavator 100, and the management controller (second processing apparatus) 150 that is disposed in the management server (server) 51 and is configured to perform processing of receiving the construction history data and generating the terrain profile data on the basis of the received construction history data.

With this configuration, the management server 51 operated by the manager generates the terrain profile data on the basis of the construction history data transmitted from the hydraulic excavator 100. Therefore, the manager can easily perform progress management of work by the hydraulic excavator 100, at a place separated from the hydraulic excavator 100.

(5) The information about the plane constituting the trajectory is information representing a vector n normal to the plane constituting the trajectory of the bucket 10. Therefore, the information about the plane in one grid can be set to be three components.

(6) The terrain profile data generating system 180 determines whether or not the bucket 10 of the hydraulic excavator 100 is in contact with a ground, and computes the information about the plane constituting the trajectory of the bucket 10 on the basis of position coordinates of freely-selected points on the moving work device when the bucket 10 of the hydraulic excavator 100 is in contact with the ground. Accordingly, when the bucket 10 is not in contact with the ground, the processing of computing the information about the plane constituting the trajectory of the bucket 10 does not need to be performed. It is therefore possible to reduce a computation load and reduce an amount of data generated.

(7) When the hydraulic excavator 100 is performing the excavating operation, two points at the left and right ends of the claw tip of the bucket 10 are set as monitor points. When the hydraulic excavator 100 is performing the compacting operation, two points at the left and right ends of a specific part on the back surface of the bucket 10 are set as monitor points. When the hydraulic excavator 100 is performing the bumping operation, points at the four corners of the bottom surface of the bucket 10 are set as monitor points. Accordingly, the trajectory of the bucket 10 can be computed appropriately according to work content. As a result, as compared with a case where the monitor points are not changed irrespective of work, the terrain profile data can be generated with high accuracy.

The following modifications are also within the scope of the present invention, and it is possible to combine a configuration illustrated in a modification with a configuration described in the foregoing embodiment, or combine configurations described in different modifications in the following with each other.

<Modification 1>

Figure 20:
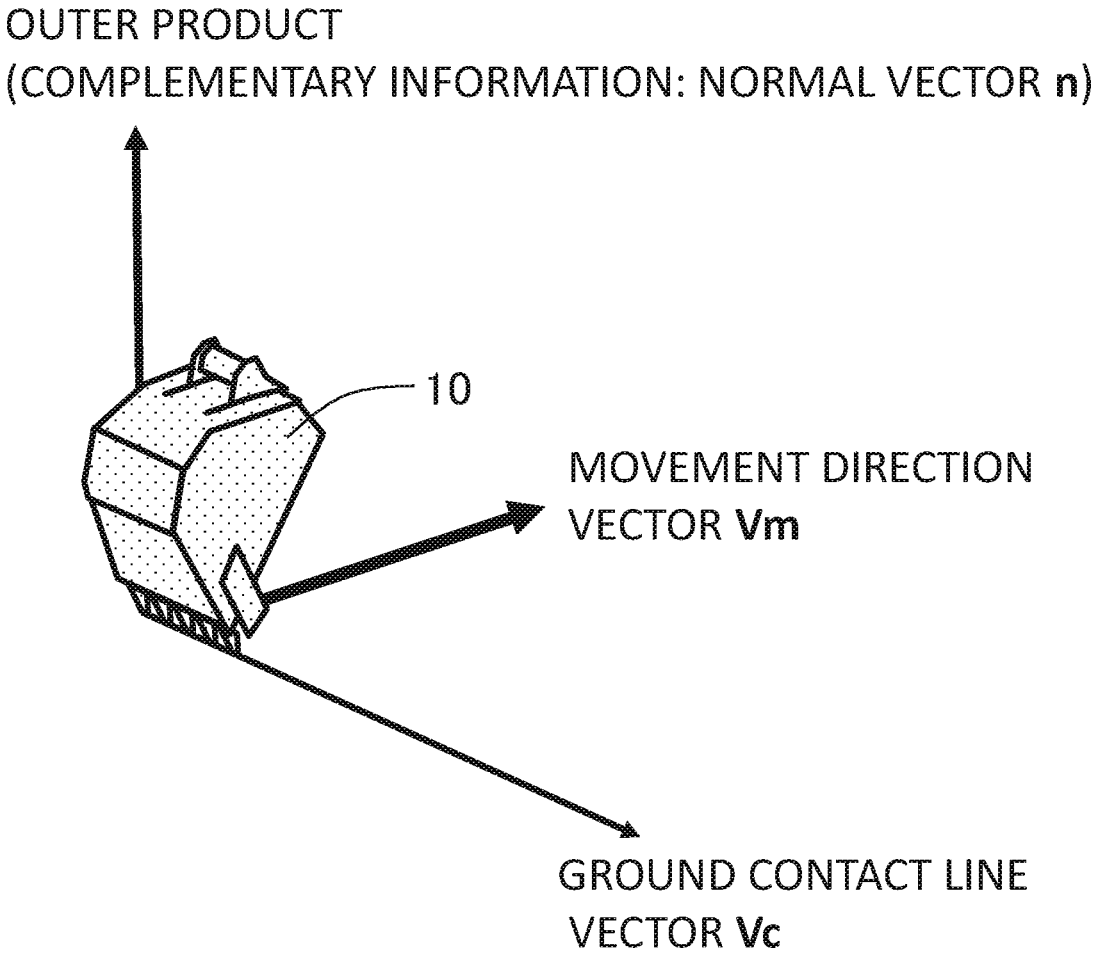
FIG. 20 is a diagram illustrating complementary information generated by a management system according to a modification 1 of the present embodiment.

In the foregoing embodiment, description has been made of an example in which normal vectors n are computed by using the points P1 to P4 (see FIG. 7 and FIG. 8). However, the present invention is not limited to this. FIG. 20 is a diagram illustrating complementary information generated by a management system 1 according to a modification 1 of the present embodiment. As illustrated in FIG. 20, the present modification computes, as the complementary information, a normal vector n obtained from an outer product of a vector Vm in a direction in which the bucket 10 moves (written also as a movement direction vector) and a vector Vc connecting two points of the bucket 10 which points are in contact with the ground with each other (written also as a ground contact line vector).

The ground contact line vector Vc is computed from the positional information of monitor points. The movement direction vector Vm is computed on the basis of Equation (4) using the dimensions $L_{bm}$, Lam, and Lbkt of the boom 8, the arm 9, and the bucket 10 and the posture information (the azimuth angle θy, the roll angle θr, the pitch angle θp, the boom angle α, the arm angle and the bucket angle γ).

[Math. 4]

$$Vm = Rx(\theta_r) \cdot Ry(\theta_p) \cdot Rz(\theta_y) \begin{pmatrix} \frac{dX}{dt} \\ \frac{dY}{dt} \\ \frac{dZ}{dt} \end{pmatrix} \quad (4)$$

Incidentally, X, Y, and Z used here are the same as those used in Equation (3). dX/dt, dY/dt, and dZ/dt are time differentials of X, Y, and Z.

In the present modification 1, the complementary information computing section 112 computes the normal vector n as complementary information from the outer product of the movement direction vector Vm and the ground contact line vector Vc. Such a modification produces actions and effects similar to those of the foregoing embodiment. The present modification 1 can compute the normal vector in an operation in which the bucket 10 moves while being in contact with the ground, as in the excavating operation and the compacting operation.

<Modification 2>

In the foregoing embodiment, description has been made of an example in which the complementary information is information representing the vector n normal to the plane constituting the trajectory of the bucket 10. However, the present invention is not limited to this. It suffices for the complementary information to be information about the plane constituting the trajectory of the bucket 10, and to be information that can identify the normal vector n (information about the normal vector n). In the following, modifications of the complementary information will be described.

<Modification 2-1>

In the foregoing embodiment, description has been made of an example in which the normal vector n (ne, nn, nh) represented by three components is set as the complementary information. In the present modification 2-1, on the other hand, the complementary information is set to be two components, that is, an inclination Ae of the plane constituting the trajectory of the bucket 10 with respect to the E-axis and an inclination An of the plane constituting the trajectory of the bucket 10 with respect to the N-axis. The inclination Ae of the plane constituting the trajectory with respect to the E-axis is nh/ne, and the inclination An of the plane constituting the trajectory with respect to the N-axis is nh/nn.

The complementing section 153 computes a normal vector n=(1/Ae, 1/An, 1) on the basis of the inclinations Ae and An. Hence, the terrain profile data can be generated by a method similar to that of the foregoing embodiment. Accordingly, in the present modification 2-1, the complementary information is information about the inclinations of the plane constituting the trajectory of the bucket 10 with respect to the reference plane (the horizontal plane, an E-N plane, or the like). With this configuration, the number of dimensions of the complementary information can be set to be "2," so that the data volume of the construction history data can be reduced as compared with the foregoing embodiment. As a result, it is possible to achieve reductions in the memory capacities of the storage devices 52 and 169 and communication volume.

<Modification 2-2>

When the number of dimensions is to be further reduced, information that associates a vector normal to a specific plane on shape data estimated to represent a shape similar to the trajectory of the bucket 10, such as the target surface data, with the vector normal to the plane constituting the trajectory of the bucket 10 may be set as the complementary information. For example, IDs as unique identification information may be set to all of surfaces constituting the target surface data in advance, and the ID of a target surface closest to monitor points at a certain time point may be set as the complementary information.

The complementing section 153 computes the normal vector n on the basis of the ID of the target surface. Hence, the terrain profile data can be generated by a method similar to that of the foregoing embodiment. Accordingly, in the present modification 2-2, the complementary information is information (ID) for identifying the target surface in the vicinity of the trajectory of the bucket 10 (target surface closest to the trajectory constituent point Gt). With this configuration, the number of dimensions of the complementary information can be set to be "1," so that the data volume of the construction history data can further be reduced as compared with the modification 2-1. As a result, it is possible to achieve further reductions in the memory capacities of the storage devices 52 and 169 and communication volume.

<Modification 3>

In the foregoing embodiment, description has been made of an example in which, with regard to log data whose construction areas are determined to overlap each other, that is, log data whose combination of E-coordinates and N-coordinates overlaps that of other log data, the extracting section 152 estimates and extracts log data having a minimum target surface interval distance, among these pieces of log data, as log data closest to the present-condition terrain profile shape. However, the present invention is not limited to this. Times or heights in the H-axis direction of these pieces of log data may be compared with each other, and log data may be extracted on the basis of a result of the comparison.

Figure 21:
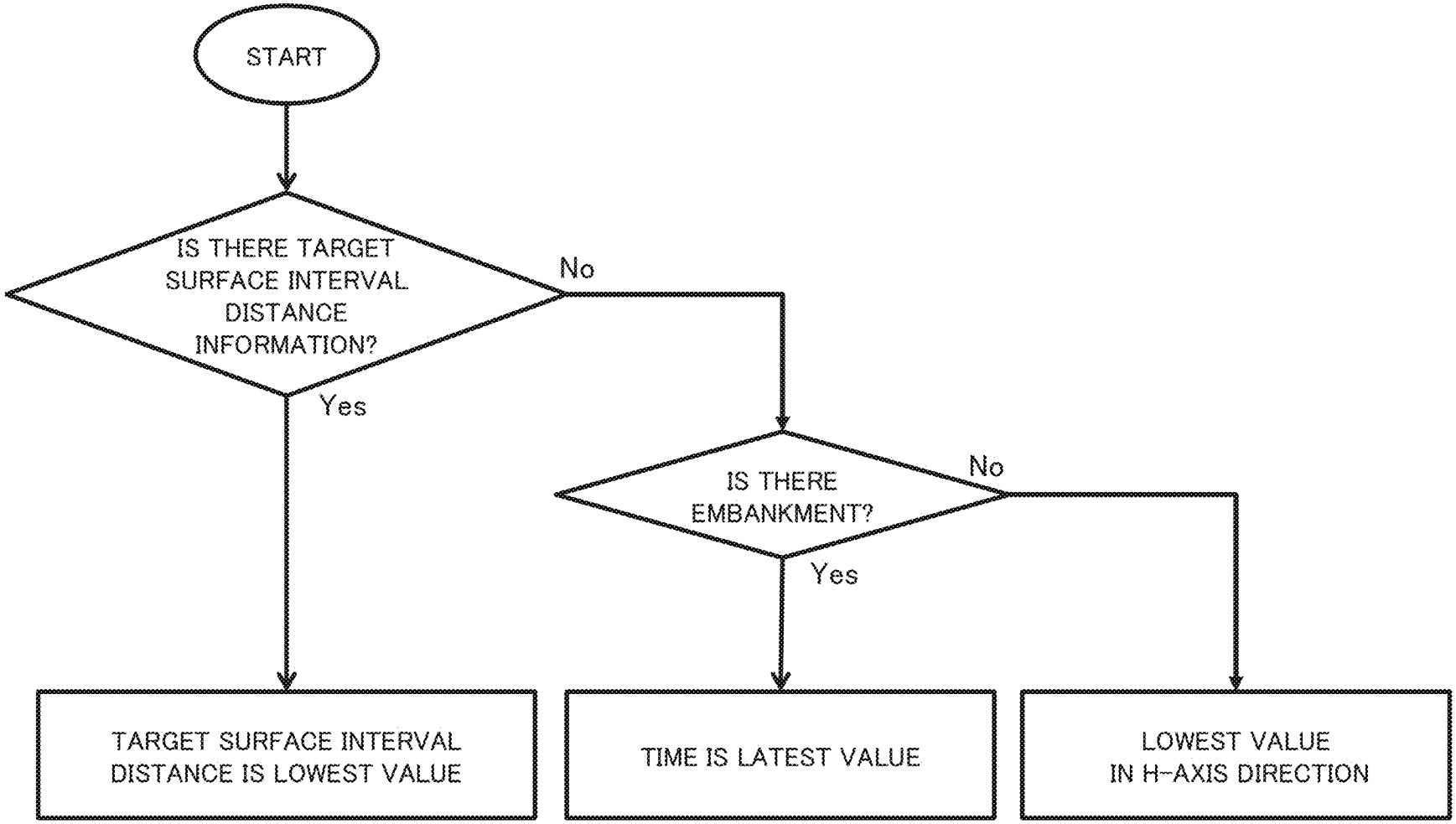
FIG. 21 is a flowchart of assistance in explaining an example of a method of setting a condition for extracting log data of the construction history data.

FIG. 21 is a flowchart of assistance in explaining an example of a method of setting a condition for extracting log data of the construction history data. As illustrated in FIG. 21, first, when the log data of the construction history data includes target surface interval distance information, the "target surface interval distance is a minimum value" is preferably set as an extracting condition because the present-condition terrain profile is considered to gradually approach the target surface. When the log data of the construction history data does not include the target surface interval distance information and there is no embankment part on the site (when there is only cut earth), an extracting condition of a "lowest value in the H-axis direction" is preferably adopted because the height of the present-condition terrain profile is considered to change in a decreasing direction at all times. When the log data of the construction history data does not include the target surface interval distance information and there is an embankment part on the site, an extracting condition using time information, that is, "time is a latest value," is preferably used instead of the condition in the height direction because the height of the present-condition terrain profile is expected to increase and decrease.

By thus comparing heights in the H-axis direction between pieces of log data whose construction areas overlap each other and extracting log data having a lowest height in the H-axis direction or extracting log data whose time is a latest value between the pieces of log data whose construction areas overlap each other, it is possible to extract the log data even in an area where the target surface data is not present.

<Modification 4>

In the foregoing embodiment, description has been made of an example in which the machine controller 110 disposed in the hydraulic excavator 100 functions as the first processing apparatus that performs the processing of generating the construction history data on the basis of the posture of the hydraulic excavator 100 sensed by the posture sensor 130 and transmitting the generated construction history data to the management server 51 external to the hydraulic excavator 100, and the management controller 150 disposed in the management server 51 functions as the second processing apparatus that performs the processing of generating the terrain profile data on the basis of the construction history data received from the machine controller 110. However, the present invention is not limited to this. The machine controller 110 of the hydraulic excavator 100 may be provided with the function as the second processing apparatus.

<Modification 5>

In the foregoing embodiment, description has been made of an example in which the operation devices (22*a*, 22*b*, 23*a*, and 23*b*) are operation devices of an electric type. However, the present invention is not limited to this. Operation devices of a hydraulic pilot type may be employed in place of the operation devices of the electric type.

<Modification 6>

In the foregoing embodiment, description has been made of an example in which the complementary information computing section 112 selects three points close to the target surface St among the points P1 to P4 (see FIG. 8) to compute the normal vector n. However, a surface different from the target surface St may be set as the reference plane, and three points close to the reference plane may be selected to compute the normal vector n. In addition, normal vectors n may be computed from all combinations of a plurality of points obtained, and an average or a weighted average of these normal vectors n may be obtained.

<Modification 7>

Description has been made of an example in which the angle sensors 30, 31, and 32 are used as posture sensors. However, the present invention is not limited to this. Stroke sensors that sense the cylinder lengths of the boom cylinder 5, the arm cylinder 6, and the bucket cylinder 7 may be adopted as posture sensors in place of the angle sensors 30, 31, and 32. In this case, the posture sensor computes the boom angle α, the arm angle β, and the bucket angle γ on the basis of the cylinder lengths sensed by the stroke sensors.

<Modification 8>

In the foregoing embodiment, description has been made by taking as an example a case where the work machine is a crawler type hydraulic excavator. However, the present invention is not limited to this. The work machine may be a wheeled hydraulic excavator, a bulldozer, a wheel loader, or the like.

<Modification 9>

In the foregoing embodiment, description has been made of an example in which hydraulic actuators such as hydraulic motors and hydraulic cylinders are provided as actuators. However, the present invention may be applied to a work machine provided with electric actuators such as electric motors and electric cylinders as actuators.

An embodiment of the present invention has been described above. However, the foregoing embodiment merely represents a part of examples of application of the present invention and is not intended to limit the technical scope of the present invention to specific configurations of the foregoing embodiment.

DESCRIPTION OF REFERENCE CHARACTERS

1: Management system
5: Boom cylinder (actuator)
6: Arm cylinder (actuator)
7: Bucket cylinder (actuator)
8: Boom (driven member)
9: Arm (driven member)
10: Bucket (driven member)
11: Track structure
12: Swing structure
14: Engine
17: Cab
22*a*, 22*b*, 23*a*, 23*b*: Operation device
30: Boom angle sensor
31: Arm angle sensor
32: Bucket angle sensor
33*a*: Machine body longitudinal inclination angle sensor
33*b*: Machine body lateral inclination angle sensor
35*a*: First GNSS antenna
35*b*: Second GNSS antenna
36: GNSS receiving device
50: Management center
51: Management server (server)
52: Storage device
53: Display device
54: Input device
55: Communicating device
100: Hydraulic excavator
100*a*: Work device
100*b*: Machine body
110: Machine controller (first processing apparatus)
111: Trajectory computing section
112: Complementary information computing section
113: Construction history generating section
114: Transmitting section
130: Posture sensor
131: Work device posture sensing section
132: Machine body position sensing section
133: Machine body angle sensing section
150: Management controller (second processing apparatus)
151: Receiving section
152: Extracting section
153: Complementing section
154: Output section
161: Target surface setting device
162: Pressure sensor
163: Operation sensor
169: Storage device
180: Terrain profile data generating system
A: Predetermined area (work area)
G: Grid
Gc: Complementary point
Gen: Grid center point
Gt: Trajectory constituent point
Gw: Grid width
n: Normal vector
St: Target surface
T1, T2: Tangent plane
Vc: Ground contact line vector
Vm: Movement direction vector

The invention claimed is:

1. A work machine management system comprising:

a terrain profile data generating system configured to generate terrain profile data representing a finished shape produced by a work device of a work machine, on a basis of a sensing result of a posture sensor that senses a posture of the work machine, the terrain profile data generating system being configured to:

compute a trajectory of the work device that is constituted by movement trajectories of a plurality of monitor points set on the work device at intervals in a width direction of the work device on a basis of the posture of the work machine, compute information about a vector normal to a plane constituting the trajectory of the work device as complementary information on a basis of the trajectory, generate construction history data by recording positional information of the trajectory of the work device and the complementary information for each of a plurality of grids obtained by dividing a predetermined area in a lattice manner, compute a plane tangent to the trajectory in each grid on a basis of the positional information of the trajectory of the work device and the complementary information, the positional information and the complementary information being recorded for each of the plurality of grids, the positional information and the complementary information being included in the construction history data, compute positional information related to a line of intersection of planes tangent to the trajectory in respective grids adjacent to each other as complementary positional information between the grids adjacent to each other, and generate the terrain profile data on a basis of the positional information of the trajectory of the work device and the complementary positional information.

2. The work machine management system according to claim 1, wherein the terrain profile data generating system is configured to:

accumulate log data of the construction history data, estimate and extract log data in which the trajectory of the work device is close to a present-condition terrain profile shape in the log data of the construction history data, and generate the terrain profile data on a basis of the extracted log data.

3. The work machine management system according to claim 1, wherein the terrain profile data generating system includes:

a first processing apparatus that is disposed in the work machine and is configured to perform processing of generating the construction history data on the basis of the posture of the work machine, the posture being sensed by the posture sensor, and transmitting the generated construction history data to a server external to the work machine, and a second processing apparatus that is disposed in the server and is configured to perform processing of receiving the construction history data and generating the terrain profile data on a basis of the received construction history data.

4. The work machine management system according to claim 1, wherein the information about the plane constituting the trajectory is information of a normal vector computed from an outer product of a vector in a direction in which the work device moves and a vector connecting two points of the work device to each other, the two points being in contact with a ground.

5. The work machine management system according to claim 1, wherein the information about the plane constituting the trajectory is information about inclinations of the plane constituting the trajectory of the work device with respect to a reference plane.

6. The work machine management system according to claim 1, wherein the information about the plane constituting the trajectory is information about a target surface in a vicinity of the trajectory of the work device.

7. The work machine management system according to claim 1, wherein the terrain profile data generating system is configured to;

determine whether the work device of the work machine is in contact with a ground, and compute the information about the plane constituting the trajectory of the work device on a basis of position coordinates of freely-selected points on the moving work device, when the work device of the work machine is in contact with the ground.

8. The work machine management system according to claim 1, wherein the terrain profile data generating system is configured to:

determine whether the work machine is performing an excavating operation, and compute the information about the plane constituting the trajectory of the work device on a basis of position coordinates of freely-selected points on the work device moved by the excavating operation, when the work machine is performing the excavating operation.

9. The work machine management system according to claim 1, wherein the terrain profile data generating system is configured to:

determine whether or not the work machine is performing a bumping operation, and compute the information about the plane constituting the trajectory of the work device on a basis of position coordinates of freely-selected points on a surface of the work device, the surface pressing a ground, when the work machine is performing the bumping operation.

* * * * *